US008791883B2

(12) United States Patent
Ebisuno et al.

(10) Patent No.: US 8,791,883 B2
(45) **Date of Patent: *Jul. 29, 2014**

(54) ORGANIC EL DISPLAY DEVICE AND CONTROL METHOD THEREOF

(75) Inventors: Kouhei Ebisuno, Kyoto (JP); Shinya Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/419,754

(22) Filed: Mar. 14, 2012

(65) Prior Publication Data

US 2012/0169707 A1 Jul. 5, 2012

Related U.S. Application Data

(63) Continuation of application No. PCT/JP2010/002464, filed on Apr. 5, 2010.

(51) Int. Cl.
*G09G 3/30* (2006.01)

(52) U.S. Cl.
USPC ..... 345/76; 345/77; 345/212; 345/690

(58) Field of Classification Search
CPC ..... G09G 3/3406; G09G 3/3426; G09G 2300/0861; G09G 2320/0233; G09G 2300/021; G09G 2300/0866; G09G 2330/028; G09G 3/3233; G09G 3/325; G09G 3/342; G09G 2330/021; G09G 3/3696; G09G 2330/02; G09G 2300/0842
USPC ..... 345/36, 38–39, 45–46, 48, 50, 51–52, 345/76–103, 204–215, 690–699; 341/118, 341/122
See application file for complete search history.

(56) References Cited

U.S. PATENT DOCUMENTS

| | | | |
|---|---|---|---|
| 7,167,147 | B2 | 1/2007 | Tanaka et al. |
| 2001/0007447 | A1 | 7/2001 | Tanaka et al. |

(Continued)

FOREIGN PATENT DOCUMENTS

| | | |
|---|---|---|
| JP | 05-218432 | 8/1993 |
| JP | 2001-195028 | 7/2001 |
| JP | 2002-108252 | 4/2002 |
| JP | 2007-156443 | 6/2007 |
| JP | 2009-048212 | 3/2009 |

(Continued)

OTHER PUBLICATIONS

U.S. Appl. No. 13/419,763 to Kouhei Ebisuno, which was filed Mar. 14, 2012.

(Continued)

*Primary Examiner* — Amare Mengistu
*Assistant Examiner* — Gloryvid Figueroa-Gibson
(74) *Attorney, Agent, or Firm* — Greenblum & Bernstein, P.L.C.

(57) ABSTRACT

An organic electroluminescent display device includes a display that includes pixels arranged in a matrix. Each pixel includes a driver, a capacitor between a gate and a source of the driver, a switch, and a luminescent element connected to the drain of the driver. Scan lines provide a scan signal for scanning the pixels. Data lines provide a signal voltage to the pixels. Power lines are electrically connected to the source and the drain of the driver. The driver includes a back gate electrode which is provided a predetermined bias voltage. A drive circuit provides the predetermined bias voltage to the back gate electrode so that the absolute value of a threshold voltage of the driver is greater than a gate-source voltage of the driver to place the driver in a non-conducting state.

8 Claims, 13 Drawing Sheets

(56) References Cited

U.S. PATENT DOCUMENTS

| | | | | |
|---|---|---|---|---|
| 2003/0030381 | A1* | 2/2003 | Yamazaki et al. | 315/169.1 |
| 2004/0174349 | A1* | 9/2004 | Libsch et al. | 345/204 |
| 2005/0057459 | A1 | 3/2005 | Miyazawa | |
| 2007/0126728 | A1 | 6/2007 | Peng | |
| 2007/0139314 | A1* | 6/2007 | Park | 345/76 |
| 2009/0009537 | A1* | 1/2009 | Shimatani | 345/690 |
| 2009/0278771 | A1 | 11/2009 | Yamamoto et al. | |
| 2010/0053041 | A1 | 3/2010 | Abe et al. | |
| 2010/0220118 | A1 | 9/2010 | Kanegae et al. | |
| 2010/0277402 | A1 | 11/2010 | Miyazawa | |
| 2011/0122324 | A1* | 5/2011 | Yamashita et al. | 348/739 |

FOREIGN PATENT DOCUMENTS

| | | |
|---|---|---|
| JP | 2009-063607 | 3/2009 |
| JP | 2009-069571 | 4/2009 |
| JP | 2009-251205 | 10/2009 |
| JP | 2009-271320 | 11/2009 |
| JP | 2010-060816 | 3/2010 |
| WO | 2009/041061 | 4/2009 |

OTHER PUBLICATIONS

International Search Report in PCT/JP2010/002464, dated Jun. 22, 2010.

* cited by examiner

ORGANIC EL DISPLAY DEVICE AND CONTROL METHOD THEREOF

CROSS REFERENCE TO RELATED APPLICATION

This is a continuation application of PCT Application No. PCT/JP2010/002464 filed on Apr. 5, 2010, designating the United States of America, the disclosure of which, including the specification, drawings and claims, is incorporated herein by reference in its entirety.

BACKGROUND OF THE INVENTION

1. Field of the Invention

The present invention relates to active-matrix organic electroluminescent (EL) display devices using organic EL elements.

2. Description of the Related Art

In organic electroluminescent (EL) display devices, a display unit is provided in which pixel units each including a luminescent element and a driving element for driving the luminescent element are arranged in a matrix, and multiple scan lines and multiple data lines are provided so as to correspond to the pixel units included in the display unit. For example, in the case where each of the pixel units is composed of two transistors and one capacitor and the first power lines electrically connected to source electrodes of the driving elements are provided in directions both parallel to and orthogonal to the scan lines so as to form a grid pattern, the gate electrode of the driving element is connected to the first electrode of the capacitor and the source electrode of the driving element is connected to the second electrode of the capacitor (refer to Japanese Patent Application Publication No. 2002-108252, for example). In this case, a signal voltage is provided to the first electrode of the capacitor, and a voltage at the second electrode of the capacitor connected to the source electrode is determined according to a voltage in the first power line. It is to be noted that the rows may be hereinafter referred to as lines.

SUMMARY OF THE INVENTION

The above conventional technique, however, have the following problems.

That is, in the line in operation for producing luminescence among the lines parallel to the scan lines, the voltage fluctuates due to a voltage drop which occurs when a current flows in the first power line. At this time, in the case where a signal voltage corresponding to a video signal is written in each of the pixel units included in a line adjacent to the line in operation for producing luminescence, the grid pattern of the first power lines leads to the result that the first power line provided to the line in operation for writing the signal voltage is influenced by the voltage drop in the first power line provided to the line in operation for producing luminescence, via wiring provided in the direction perpendicular to the scan lines. In other words, a voltage drop in the first power line for the line which is provided in parallel with the scan lines and is in operation for producing luminescence transmits to the first power line for the line which is provided in parallel with the scan lines and is in operation for writing a signal voltage. This causes a change in voltage of the first power line which corresponds to the line in operation for writing a signal voltage and is provided in the direction parallel to the scan lines.

Furthermore, the influence of the voltage drop on the lines in operation for producing luminescence is larger on a part closer to the center of the display unit, which results in variation in voltage provided from the first power lines to the respective pixel units provided in the lines in operation for writing a signal voltage.

Thus, when a signal voltage is written in the first electrode of the capacitor in a state where the first power lines have a reduced voltage due to the voltage drop, the capacitor holds a voltage lower than a desired voltage because the signal voltage is provided to the first electrode of the capacitor with the second electrode having a decreased voltage. Moreover, the voltages held by the capacitors vary among the respective pixel units. As a result, not only the luminance of the display unit becomes lower, but also there is a variation in the luminance of the display unit, which causes the problem that the display unit is unable to produce luminescence with a desired luminance.

In addition, during a period for which a signal voltage is written, the driving element may become conducting and thus, a drive current of the driving element may flow. In this case, the drive current flowing through the first power lines during the period for which a signal voltage is written causes a change in the voltage of the first power lines. As a result, a voltage lower than a desired voltage is held by the capacitor.

To solve such problems, there is a method of writing a desired voltage in a capacitor by scanning one or both of the first power line and the second power line for each of the lines parallel to the scanning lines and thereby causing the transition of a driving element between conducting and non-conducting states according to whether the luminescent element is in operation for producing luminescence or a signal voltage is written (refer to Japanese Patent Application Publication No. 2009-271320, for example). In this method, while luminescence is produced, the voltages of the first power line and the second power line are controlled so that a forward bias voltage is applied to the luminescent pixel, and while a signal voltage is provided, the voltages of the first power line and the second power line are controlled so that no forward bias voltage is applied to the luminescent element. This makes it possible to prevent a drive current from flowing to the luminescent element via the first power line within a period during which a signal voltage is provided.

However, in this case, it is necessary to additionally provide a dedicated driver for changing the voltage of the first power line and the second power line, which causes a problem of cost increase.

In the mean time, there is also a method of preventing flow of a drive current during a period for which a signal voltage is provided, by switching off, within the period, a transistor for switching additionally provided between the first and second power lines and the luminescent element (refer to Japanese Patent Application Publication No. 2009-69571, for example). This method, however, has the problem that additionally providing the transistor for switching increases the number of elements included in pixel units and the number of wiring channels for controlling the transistor, which not only reduces yield in the manufacturing process but also causes an increase in power voltage which is provided from the power supply, leading to increased power consumption.

The present invention has been devised in view of the above problems, and an object of the present invention is to provide an organic EL display device of which display unit includes pixel units each having a simplified structure and which is capable of preventing variations in luminance that are due to a voltage drop in a power line for the pixel unit in which a signal voltage is being written.

In order to achieve the above object, an organic EL display device according to an aspect of the present invention includes: a display unit including a plurality of pixel units arranged in a matrix, the pixel units each including a luminescent element and a driving element for controlling a current flow to the luminescent element; a plurality of scan lines for providing a signal for scanning the pixel units included in the display unit; a plurality of data lines for providing a signal voltage to the pixel units included in the display unit; a trunk power line disposed on a periphery of the display unit, for providing a predetermined fixed voltage to the display unit; a power supply which provides, to the trunk power line, the predetermined fixed voltage that is an external input; a plurality of first power lines which correspond to the respective scan lines, branching from the trunk power line so as to be separate from one another in the display unit, the power lines each extending along a corresponding one of the scan lines and being electrically connected to source electrodes of the driving elements; and a second power line electrically connected to a drain electrode of the driving element, wherein each of the pixel units includes: a capacitor having a first electrode connected to a gate electrode of the driving element and a second electrode connected to the source electrode of the driving element; and a switching element having one terminal connected to the data line and the other terminal connected to the first electrode of the capacitor, and selecting conduction or non-conduction between the data line and the first electrode of the capacitor, and the driving element includes a back gate electrode to which a predetermined bias voltage is provided to place the driving element in a non-conducting state, the organic EL display device further comprising: a bias line for providing the predetermined bias voltage to the back gate electrode; and a drive circuit which controls the switching element and the predetermined bias voltage that is provided to the back gate electrode, wherein the predetermined bias voltage is provided so that an absolute value of a threshold voltage of the driving element is larger than a voltage between the gate electrode and the source electrode, and the drive circuit (i) provides the bias voltage to the back gate electrode so that the absolute value of the threshold voltage of the driving element is larger than the voltage between the gate electrode and the source electrode, to place the driving element in a non-conducting state, and (ii) provides the signal voltage to the first electrode of the capacitor when the driving element is in the non-conducting state, by placing the switching element in a conducting state within a period during which the predetermined bias voltage is provided.

According to this aspect, the trunk power line is disposed on a periphery of the display unit so as to provide the predetermined fixed voltage from the power supply to the display unit, and from the trunk power line, the multiple first power lines branch and extend in parallel with the scan lines so that the adjacent first power lines are separate from each other in the display unit. As each of the first power lines is thus separate from an adjacent one of the first power lines in the display unit, the voltage of the first power line for a given row of the pixel units in which a signal voltage is to be written will not be influenced by a voltage drop in the power line for the pixel units which are adjacent to the given row and are producing luminescence.

With this, in this aspect, a predetermined bias voltage is provided to the back gate electrode, which places the driving element in a non-conducting state, and then the signal voltage is provided to the first electrode of the capacitor with the driving element in the non-conducting state. By so doing, the signal voltage is provided to the first electrode of the capacitor with the drive current suspended, which can prevent a voltage drop which occurs in the first power line due to the drive current flowing through the luminescent element during the period for which the signal voltage is provided. Accordingly, it is possible to prevent the voltage of the second electrode of the capacitor from fluctuating during the period for which the signal voltage is provided, and thus possible to maintain the capacitor at a desired voltage. As a result, it is possible to prevent variations in luminance which are due to a voltage drop in the first power line for the luminescent pixel in which the signal voltage is being written.

In the present embodiment, the back gate electrode is used as a switch for causing the transition of the driving element between conducting and non-conducting states. The predetermined bias voltage is provided so that the absolute value of the threshold voltage of the driving element is larger than the voltage between the gate electrode and the source electrode of the driving element. As the transition of the driving element between the conducting and non-conducting states is controlled through control of the bias voltage to be provided, the back gate electrode can be used as a switching element. This eliminates the need of providing another switching element for cutting the drive current off during the period for which the signal voltage is written.

Thus, in this aspect, during the period for which the signal voltage is written, not only the first power line is separate from another first power line for the adjacent row of the pixel units in the display unit, but also the driving element is provided with an additional function as a switch by using its back gate electrode. This eliminates the need of providing a switching element for cutting the drive current off during the period for which the signal voltage is written, which makes it possible to simplify the structure of each of the pixel units and thereby reduce the production cost of the present device.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings.

DESCRIPTION OF THE PREFERRED EMBODIMENT(S)

Figure 1:
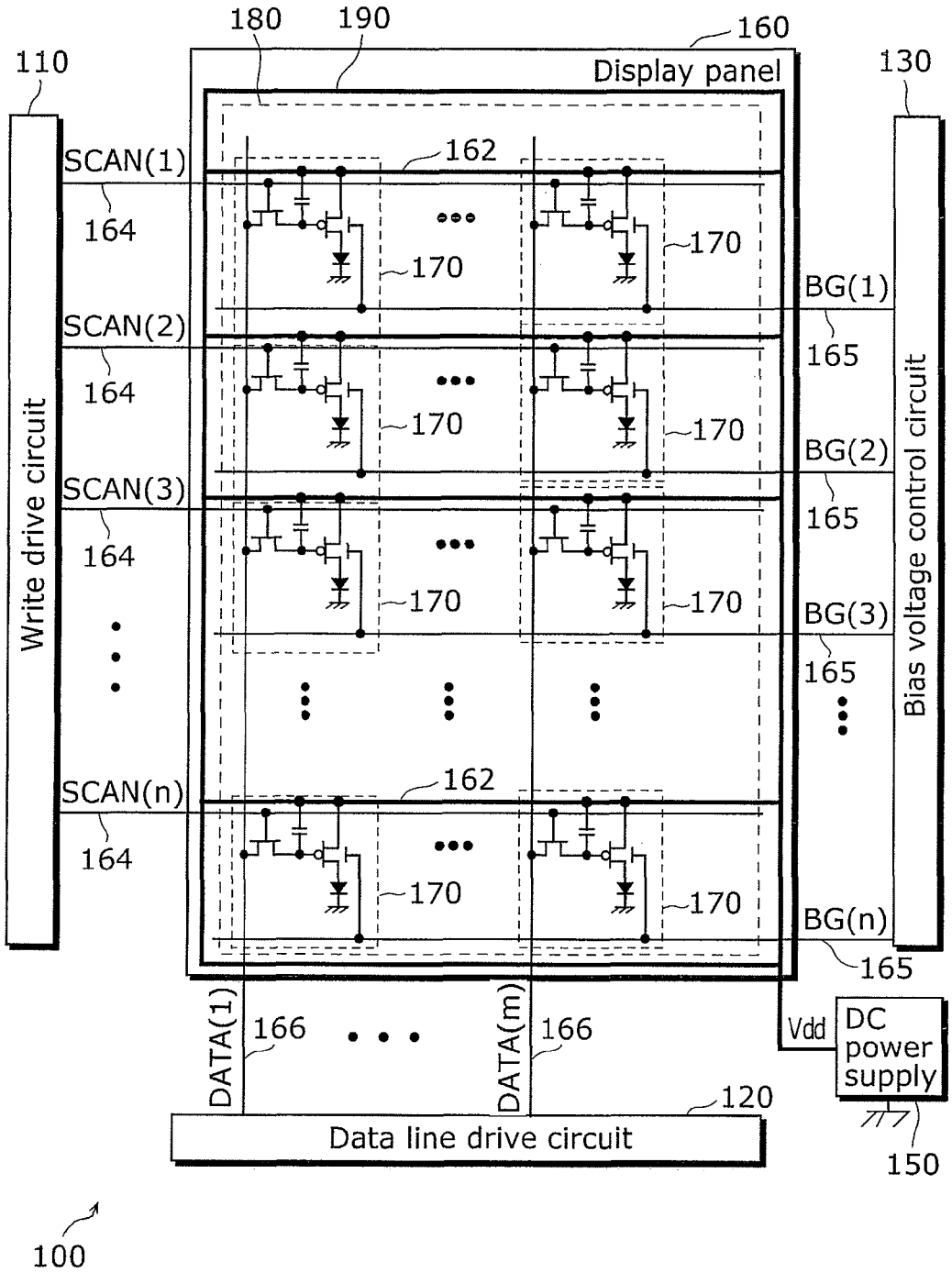
FIG. 1 is a block diagram showing a configuration of an organic EL display device according to the first embodiment.

An organic EL display device according to an aspect of the present invention includes: a display unit including a plurality of pixel units arranged in a matrix, the pixel units each including a luminescent element and a driving element for controlling a current flow to the luminescent element; a plurality of scan lines for providing a signal for scanning the pixel units included in the display unit; a plurality of data lines for providing a signal voltage to the pixel units included in the display unit; a trunk power line disposed on a periphery of the display unit, for providing a predetermined fixed voltage to the display unit; a power supply which provides, to the trunk power line, the predetermined fixed voltage that is an external input; a plurality of first power lines which correspond to the respective scan lines, branching from the trunk power line so as to be separate from one another in the display unit, the power lines each extending along a corresponding one of the scan lines and being electrically connected to source electrodes of the driving elements; and a second power line electrically connected to a drain electrode of the driving element, wherein each of the pixel units includes: a capacitor having a first electrode connected to a gate electrode of the driving element and a second electrode connected to the source electrode of the driving element; and a switching element having one terminal connected to the data line and the other terminal connected to the first electrode of the capacitor, and selecting conduction or non-conduction between the data line and the first electrode of the capacitor, and the driving element includes a back gate electrode to which a predetermined bias voltage is provided to place the driving element in a non-conducting state, the organic EL display device further comprising: a bias line for providing the predetermined bias voltage to the back gate electrode; and a drive circuit which controls the switching element and the predetermined bias voltage that is provided to the back gate electrode, wherein the predetermined bias voltage is provided so that an absolute value of a threshold voltage of the driving element is larger than a voltage between the gate electrode and the source electrode, and the drive circuit (i) provides the bias voltage to the back gate electrode so that the absolute value of the threshold voltage of the driving element is larger than the voltage between the gate electrode and the source electrode, to place the driving element in a non-conducting state, and (ii) provides the signal voltage to the first electrode of the capacitor when the driving element is in the non-conducting state, by placing the switching element in a conducting state within a period during which the predetermined bias voltage is provided.

According to the present aspect, the trunk power line is disposed on a periphery of the display unit so as to provide the predetermined fixed voltage from the power supply to the display unit, and from the trunk power line, the multiple first power lines branch and extend in parallel with the scan lines so that the adjacent first power lines are separate from each other in the display unit. As each of the first power lines is thus separate from an adjacent one of the first power lines in the display unit, the voltage of the first power line for a given row of the pixel units in which a signal voltage is to be written will not be influenced by a voltage drop in the power line for the pixel units which are adjacent to the given row and are producing luminescence.

With this, in the present aspect, a predetermined bias voltage is provided to the back gate electrode, which places the driving element in a non-conducting state, and then the signal voltage is provided to the first electrode of the capacitor with the driving element in the non-conducting state. By so doing, the signal voltage is provided to the first electrode of the capacitor with the drive current suspended, which can prevent a voltage drop which occurs in the first power line due to the drive current flowing through the luminescent element during the period for which the signal voltage is provided. Accordingly, it is possible to prevent the voltage of the second electrode of the capacitor from fluctuating during the period for which the signal voltage is provided, and thus possible to maintain the capacitor at a desired voltage. As a result, it is possible to prevent variations in luminance which are due to a voltage drop in the first power line for the luminescent pixel in which the signal voltage is being written.

In the present aspect, the back gate electrode is used as a switch for causing the transition of the driving element between conducting and non-conducting states. The predetermined bias voltage is provided so that the absolute value of the threshold voltage of the driving element is larger than the voltage between the gate electrode and the source electrode of the driving element. As the transition of the driving element between the conducting and non-conducting states is controlled through control of the bias voltage to be provided, the back gate electrode can be used as a switching element. This eliminates the need of providing another switching element for cutting the drive current off during the period for which the signal voltage is written.

Thus, in the present aspect, during the period for which the signal voltage is written, not only the first power line is separate from another first power line for the adjacent row of the pixel units in the display unit, but also the driving element is provided with an additional function as a switch by using its back gate electrode. This eliminates the need of providing a switching element for cutting the drive current off during the period for which the signal voltage is written, which makes it possible to simplify the structure of each of the pixel units and thereby reduce the production cost of the present device.

According to an organic EL display device according to an aspect of the present invention, the organic EL display device further includes a plurality of voltage clamp units each provided to a corresponding one of the first power lines and configured to fix a voltage of the first power line at the predetermined fixed voltage, wherein each of the first power lines branches from the trunk power line via a corresponding one of the voltage clamp units.

In the case where each of the first power lines directly branches from the trunk power line, the drive current flows in the rows of the pixels units which are producing luminescence, causing a voltage drop in the first power lines and thus causing a voltage drop on the branch point between the trunk power line and the first power line corresponding to this row of the pixel units. The voltage of the branch point between the trunk power line and the first power line for a given row of the pixel units in which a signal voltage is written may therefore fluctuate due to such a voltage drop. As a result, the voltage of the first power line for a given row of the pixel units in which a signal voltage is written is uniform among the respective pixel units in this given row, but the voltage itself of the first power line changes to a level lower than the fixed voltage of the power supply.

According to an organic EL display device according to an aspect of the present invention, the organic EL display device further includes a plurality of voltage clamp units each provided to a corresponding one of the first power lines and configured to fix a voltage of the first power line at the predetermined fixed voltage, wherein each of the first power lines branches from the trunk power line via a corresponding one of the voltage clamp units. The voltage clamp units hold the voltages of the respective first power lines at the predetermined fixed voltage, so that it is possible to prevent the voltage drop in the first power lines for the given row of the pixel units in which a signal voltage is written from influencing, via the trunk power line, the first power line for the row of the pixel units which are producing luminescence.

The pixel unit included in the display unit is thus capable of producing luminescence with a desired luminance.

According to an organic EL display device according to an aspect of the present invention, each of the voltage clamp units is made up of a voltage follower circuit.

For example, in the configuration disclosed in Japanese Unexamined Patent Application Publication No. 2009-271320, a dedicated driver is provided as means for applying a fixed voltage to the first power line in writing of the signal voltage. In this case, it is necessary to switch between the period for which the predetermined fixed voltage is provided to the first power lines by scanning them and the period for which the drive current is provided. The dedicated driver therefore requires a complicated circuit such as a shift register, which leads to an increase in cost.

According to the present aspect, the voltage clamp unit is made up of only a voltage follower circuit. Consequently, outputs of the voltage clamp units can be a single value that is the predetermined fixed voltage, which means that the voltage clamp units do not need to perform scanning nor switching of signals. It is therefore possible to hold the voltages of the first power lines at the predetermined fixed voltage with a simpler structure than in the case of providing the dedicate driver for holding the voltages of the first power lines at the predetermined fixed voltage. As a result, the production cost can be reduced.

According to an organic EL display device according to an aspect of the present invention, the predetermined bias voltage provided so that the absolute value of the threshold voltage of the driving element is larger than the voltage between the gate electrode and the source electrode is a voltage which is set so that the absolute value of the threshold voltage is larger than the voltage between the gate electrode and the source electrode when the gate electrode of the driving element is provided with a predetermined signal voltage required to cause the luminescent element included in each of the pixel units to produce luminescence with a maximum gradation level.

According to the present aspect, the predetermined bias voltage is set so that the absolute value of the threshold voltage is larger than the voltage between the gate electrode and the source electrode of the driving element when the gate electrode of the driving element is supplied with the predetermined signal voltage that is required to cause the luminescent element in each of the pixel units to produce luminescence with the maximum gradation level. In this case, setting the predetermined bias voltage allows the driving element to have a threshold voltage of which absolute value is larger than the voltage between the gate electrode and the source electrode of the driving element, no matter what signal voltage corresponding to any one of the gradation levels is written. As a result, it is possible to stop the drive current by reliably causing the transition of the driving element to the non-conducting state when a signal voltage is being written.

According to an organic EL display device according to an aspect of the present invention, the period during which the predetermined bias voltage is provided to the back gate electrode is the same as a period during which the signal voltage is provided to the first electrode of the capacitor.

According to the present aspect, the period for which the predetermined bias voltage is provided to the back gate electrode may be the same as the period for which the switching element stays on.

According to an organic EL display device according to an aspect of the present invention, the switching element and the driving element are made up of transistors of opposite polarities, and the scan line and the predetermined bias line are provided as a common control line. It is to be noted that providing the lines as the common line means that the lines are the same line.

According to the present aspect, the scan line and the bias line can be provided as a common control line in the case where the timing of starting to provide the bias voltage and the timing of turning switching element on are the same and where the timing of stopping providing the bias voltage and the timing of turning the switching element off are the same. This allows a reduction in the number of wiring channels in the display unit, which can simplify the circuitry design.

According to an organic EL display device according to an aspect of the present invention, the driving element is a P-type transistor.

According to an organic EL display device according to an aspect of the present invention, the drive circuit (i) provides the signal voltage to the first electrode of the capacitor and then places the switching element in the non-conducting state, (ii) provides, to the back gate electrode, a voltage lower than the predetermined bias voltage so that the absolute value of the threshold voltage of the driving element is smaller than the voltage between the gate electrode and the source electrode, to place the driving element in a conducting state, and (iii) provides, to the luminescent element, a drive current corresponding to the voltage held by the capacitor, so as to cause the luminescent element to produce luminescence.

According to the present aspect, in the case where the driving element is the P-type transistor, the signal voltage is provided to the first electrode of the capacitor, and a voltage lower than the predetermined bias voltage is then provided to the back gate electrode. As a result, the driving element undergoes the transition from the non-conducting state to the conducting state, allowing the drive current corresponding to the voltage held by the capacitor to flow and thereby causing the luminescent element to produce luminescence.

By so doing, it is possible to prevent a voltage drop which occurs in the first power line due to the drive current flowing through the first power line during the period for which the signal voltage is provided, so that the capacitor can hold a desired voltage. As a result, it is possible to allow the drive current corresponding to the desired voltage to flow, thereby causing the luminescent element to produce luminescence.

According to an organic EL display device according to an aspect of the present invention, the driving element is an N-type transistor.

According to an organic EL display device according to an aspect of the present invention, the drive circuit (i) provides the signal voltage to the first electrode of the capacitor and then places the switching element in the non-conducting state, (ii) provides, to the back gate electrode, a voltage higher than the predetermined bias voltage so that the absolute value of the threshold voltage of the driving element is smaller than the voltage between the gate electrode and the source electrode, to place the driving element in a conducting state, and (iii) provides, to the luminescent element, a drive current corresponding to the voltage held by the capacitor, so as to cause the luminescent element to produce luminescence.

According to the present aspect, in the case where the driving element is the N-type transistor, the signal voltage is provided to the first electrode of the capacitor, and a voltage higher than the predetermined bias voltage is then provided to the back gate electrode. As a result, the driving element undergoes the transition from the non-conducting state to the conducting state, allowing the drive current corresponding to the voltage held by the capacitor to flow and thereby causing the luminescent element to produce luminescence.

By so doing, it is possible to prevent a voltage drop which occurs in the first power line due to the drive current flowing through the first power line during the period for which the signal voltage is provided, so that the capacitor can hold a desired voltage. As a result, it is possible to allow the drive current corresponding to the desired voltage to flow, thereby causing the luminescent element to produce luminescence.

According to a method of controlling an organic electroluminescent (EL) display device according to an aspect of the present invention, in the organic EL display device including: a display unit including a plurality of pixel units arranged in a matrix, the pixel units each including a luminescent element and a driving element for controlling a current flow to the luminescent element; a plurality of scan lines for providing a signal for scanning the pixel units included in the display unit; a plurality of data lines for providing a signal voltage to the pixel units included in the display unit; a trunk power line disposed on a periphery of the display unit and for providing a predetermined fixed voltage to the display unit; a power supply which provides, to the trunk power line, the predetermined fixed voltage that is an external input; a plurality of first power lines which correspond to the respective scan lines, branching from the trunk power line so as to be separate from one another in the display unit, the power lines each extending along a corresponding one of the scan lines and being electrically connected to source electrodes of the driving elements; and a second power line electrically connected to a drain electrode of the driving element, wherein each of the pixel units includes: a capacitor having a first electrode connected to a gate electrode of the driving element and a second electrode connected to the source electrode of the driving element; and a switching element having one terminal connected to the data line and the other terminal connected to the first electrode of the capacitor, and selecting conduction or non-conduction between the data line and the first electrode of the capacitor, the driving element includes a back gate electrode to which a predetermined bias voltage is provided to place the driving element in a non-conducting state, the organic EL display device further includes a bias line for providing the predetermined bias voltage to the back gate electrode, and the predetermined bias voltage is provided so that an absolute value of a threshold voltage of the driving element is larger than a voltage between the gate electrode and the source electrode, the method includes: providing the bias voltage to the back gate electrode so that the absolute value of the threshold voltage of the driving element is larger than the voltage between the gate electrode and the source electrode, to place the driving element in the non-conducting state, and providing the signal voltage to the first electrode of the capacitor when the driving element is in the non-conducting state, by placing the switching element in a conducting state within a period during which the predetermined bias voltage is provided.

The following describes preferred embodiments of the present invention based on the drawings. Throughout the drawings, the same or equivalent elements are denoted by the same numerals, and their overlapping descriptions will be omitted hereinbelow.

First Embodiment

In the following, the first embodiment of the present invention is described with reference to the drawings.

FIG. 1 is a block diagram showing a configuration of an organic EL display device according to the present embodiment.

The organic EL display device 100 shown in FIG. 1 includes a write drive circuit 110, a data line drive circuit 120, a bias voltage control circuit 130, a DC power supply 150, and a display panel 160. The display panel 160 includes a display unit 180 having multiple luminescent pixels 170 arranged in n rows and m columns (n and m are each a natural number), and a trunk power line 190 disposed on a periphery of the display unit 180 and through which a predetermined fixed voltage Vdd is provided to the display unit 180, and is connected to the write drive circuit 110, the data line drive circuit 120, the bias voltage control circuit 130, and the DC power supply 150.

The organic EL display unit 100 further includes multiple scan lines 164 provided for the respective rows of the luminescent pixels 170, power lines 162 which branch from the trunk power line 190 so as to correspond to the respective rows of the luminescent pixels 170, and data lines 166 provided for the respective columns of the luminescent pixels 170.

Figure 2:
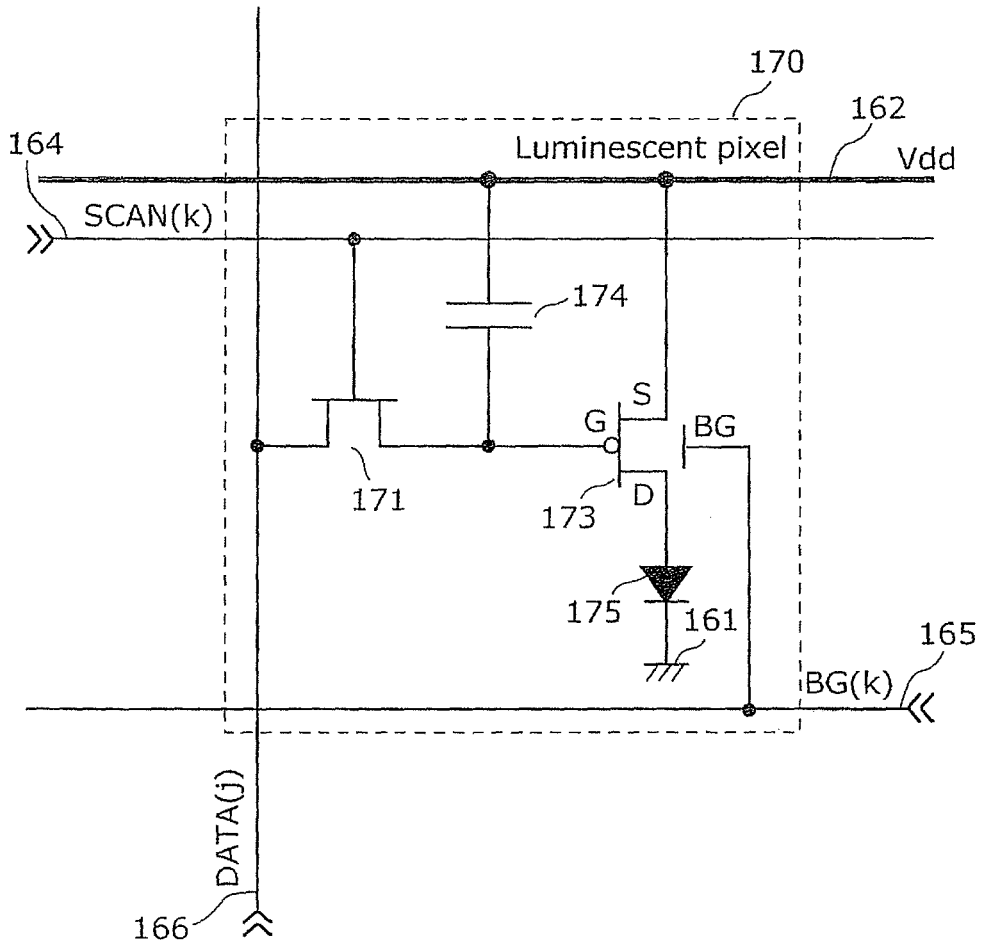
FIG. 2 is a circuit diagram showing a detailed circuitry design of a luminescent pixel.

FIG. 2 is a circuit diagram showing a detailed circuitry design of the luminescent pixel 170. FIG. 2 includes the power lines 161 and 162, the scan line 164, bias lines 165, and the data line 166, which correspond to the luminescent pixel 170.

The luminescent pixel 170 shown in FIG. 2 is the pixel unit according to an implementation of the present invention and includes a scan transistor 171, a drive transistor 173, a capacitor 174, and a luminescent element 175. While the luminescent element 170 located in the "k"-th row and the "j"-th column ($1 \le k \le n$, $1 \le j \le m$) is illustrated in FIG. 2 as an example, the other luminescent elements have the same or like structures.

As to the respective constituent elements shown in FIG. 1 and FIG. 2, their connection relationship and functions are described below.

The write drive circuit 110 is connected to the multiple scan lines 164 provided for the respective rows of the multiple luminescent pixels 170 and provides scan pulses SCAN (1) to SCAN (n) to the multiple scan lines, thereby scanning the multiple luminescent pixels 170 sequentially on a per-row basis. These scan pulses SCAN (1) to SCAN (n) are signals for controlling on and off of the scanning transistors 171.

The data line drive circuit 120 is connected to the multiple data lines 166 provided for the respective columns of the multiple luminescent pixels 170 and provides data line voltages DATA (1) to DATA (m) to the multiple data lines 166. The respective data line voltages DATA (1) to DATA (m) include, in a time-division manner, a signal voltage corresponding to the luminance of the luminescent element 175 in a corresponding column. That is, the data line drive circuit 120 provides signal voltages to the multiple data lines 166.

The data line drive circuit 120 and the bias voltage control circuit 130 correspond to the drive circuit according to an implementation of the present invention.

The bias voltage control circuit 130 is connected to the multiple bias lines 165 provided for the respective rows of the multiple luminescent pixels 170 and provides back gate pulses BG (1) to BG (n) to the multiple bias lines 165, thereby controlling the threshold voltages of the multiple luminescent pixels 170 on a per-row basis. In other words, the multiple luminescent pixels 170 undergo, in units of rows, the transition between conducting and non-conducting states. The details of control on the threshold voltages of the luminescent pixels 170 with the back gate pulses BG (1) to BG (n) will be described later.

The DC power supply 150 is the power supply unit according to an implementation of the present invention, being connected to the power lines 162 via the trunk power line 190 and providing the fixed voltage Vdd to the trunk power line 190. The fixed voltage Vdd is 15 V, for example.

The power line 161 is the second power line according to an implementation of the present invention and connected to a drain electrode of the drive transistor 173 via the luminescent element 175. This power line 161 is a ground line at a voltage of 0 V, for example.

The scan lines 164 are provided for the respective rows of the multiple luminescent pixels 170 in a manner that the multiple luminescent pixels 170 in a row share a corresponding one of the scan lines 164, and connected to the write drive circuit 110 and gate electrodes of the respective scan transistors 171 included in the corresponding luminescent pixels 170.

The bias lines 165 are provided for the respective rows of the multiple luminescent pixels 170 in a manner that the multiple luminescent pixels 170 in a row share a corresponding one of the bias lines 165, and are connected to the bias voltage control circuit 130 and back gate electrodes of the respective drive transistors 173 included in the corresponding luminescent pixels 170.

The data lines 166 are provided for the respective columns of the multiple luminescent pixels 170 in a manner that the multiple luminescent pixels 170 in a column share a corresponding one of the data lines 166, and supplied with the data line voltages DATA (1) to DATA (m) from the data line drive circuit 120.

The trunk power line 190 is disposed on the periphery of the display unit 180, and through the trunk power line 190, the fixed voltage Vdd from the DC power supply 150 is provided to the display unit 180. Specifically, the trunk power line 190 is connected to the DC power supply 150 and the multiple power lines 162 and transfers to the multiple power lines 162 the fixed voltage Vdd supplied from the DC power supply 150. The periphery of the display unit 180 indicates a region between the outer edge of the display panel 160 and the outer boundary of the minimum region which includes all the multiple luminescent pixels 170 arranged in a matrix.

The power lines 162 are each the first power line according to an implementation of the present invention, branching from the trunk power line 190 and extending in parallel with the scan lines 164. Each of the power lines 162 is connected to source electrodes of the respective drive transistors 173 included in a corresponding row of the luminescent pixels 170. The multiple power lines 162 included in the organic EL display device 100 are separate from one to another in the display unit 180. In other words, the multiple power lines 162 included in the organic EL display unit 100 are provided for the respective rows of the multiple luminescent pixels 170 and extend along the corresponding rows of the multiple luminescent pixels 170.

The scan transistor 171 is the switching element according to an implementation of the present invention, having one terminal connected to the data line 166 and the other terminal connected to the first electrode of the capacitor 174, and selecting conduction or non-conduction between the data line 166 and the first electrode of the capacitor 174. Specifically, the scan transistor 171 has the gate electrode connected to the scan line 164, one of a source electrode and a drain electrode connected to the data line 166, and the other one of the source electrode and the drain electrode connected to the first electrode of the capacitor 174. According to the scan pulse SCAN (k) provided from the write drive circuit 110 to the gate electrode via the scan line 164, the scan transistor 171 selects the conduction or non-conduction between the data line 166 and the first electrode of the capacitor 174.

The drive transistor 173 is the driving element according to an implementation of the present invention, having a source electrode S, a drain electrode D, a gate electrode G, and a back gate electrode BG. The gate electrode G is connected to the first electrode of the capacitor 174, and the source electrode S is connected to the second electrode of the capacitor 174 via the power line 162. The drive transistor 173 allows a drive current according to a voltage held by the capacitor 174 to pass through the luminescent element 175, thereby causing the luminescent element 175 to produce luminescence. When a predetermined bias voltage is provided to the back gate electrode BG, the drive transistor 173 becomes non-conducting. That is, the drive transistor 173 supplies the luminescent element 175 with the drive current, i.e., a drain current according to the voltage held by the capacitor 174. The details of this drive transistor 173 will be described later.

The capacitor 174 is a capacitor for holding a voltage which corresponds to a luminance of the luminescent element 175 of the luminescent pixel 170. Specifically, the capacitor 174 has the first electrode and the second electrode, and the first electrode is connected to the gate electrode of the drive transistor 173 and to the other one of the source electrode and the drain electrode of the scan transistor 171 while the second electrode is connected to the source electrode of the drive transistor 173 via the power line 162. That is, the first electrode of the capacitor 174 has a data line voltage DATA (j) which is provided to the data line 166 when the scan transistor 171 is conducting. The second electrode of the capacitor 174 has the fixed voltage Vdd of the power line 162.

The luminescent element 175 is, for example, an organic EL luminescent element which is caused to produce luminescence by the drain current supplied from the drive transistor 173.

The scan transistor 171 is an N-type thin-film transistor (N-type TFT), and the drive transistor 173 is a P-type thin-film transistor (P-type TFT), for example.

Next, characteristics of the above-described drive transistor 173 are described.

Figure 3:
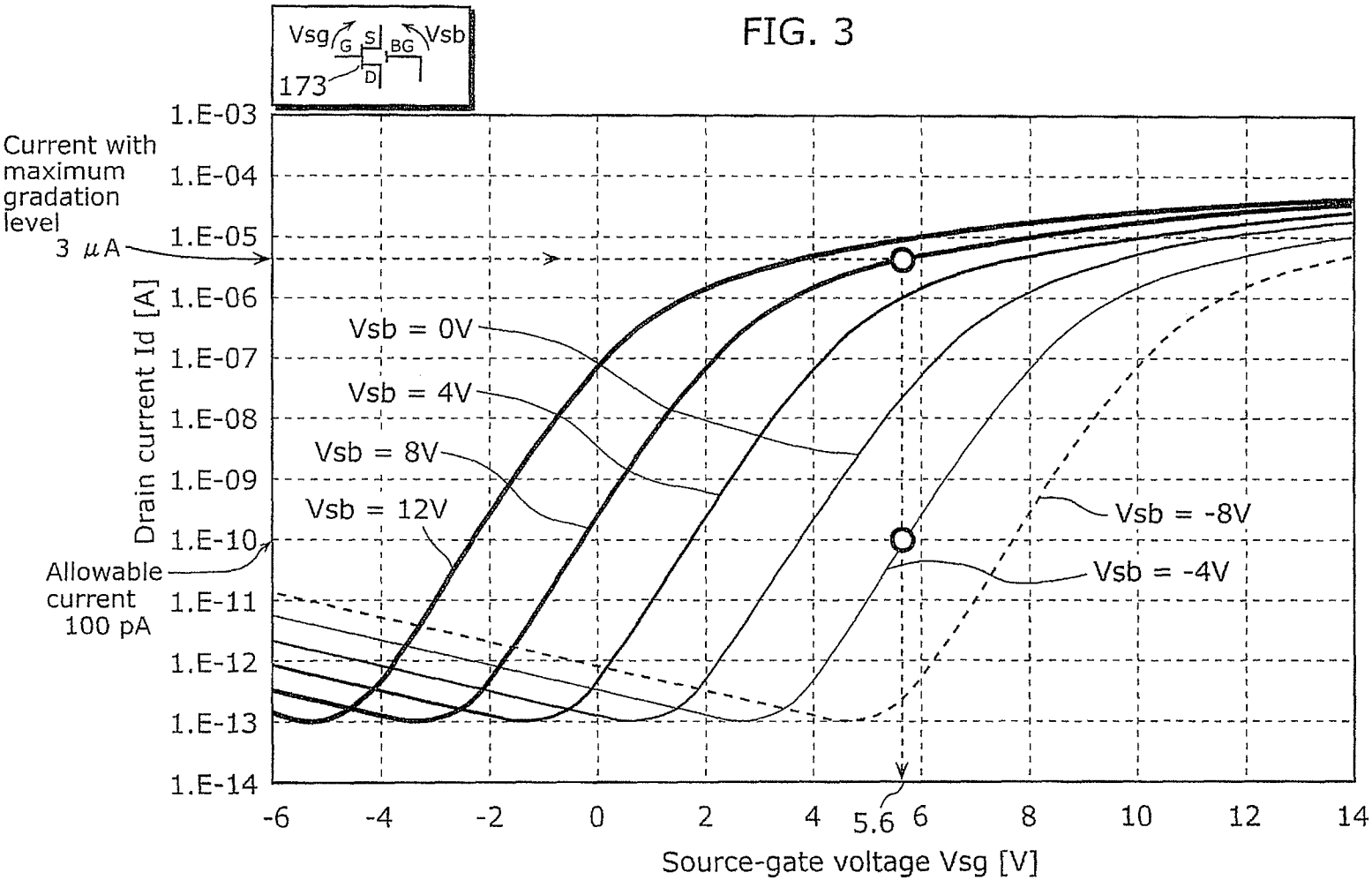
FIG. 3 is a graph showing one example of Vsg-Id characteristics of a drive transistor.

FIG. 3 is a graph showing one example of characteristics of the drain current relative to the source-gate voltage (Vsg-Id characteristics) in the drive transistor 173.

In FIG. 3, the horizontal axis represents the source-gate voltage Vsg of the drive transistor 173 while the vertical axis represents the drain current Id of the drive transistor 173. Specifically, the vertical axis indicates a voltage at the source electrode relative to a voltage at the gate electrode in the drive transistor 173, and a positive value is obtained when the voltage at the source electrode is higher than the voltage at the gate electrode while a negative value is obtained when the voltage at the source electrode is lower than the voltage at the gate electrode.

FIG. 3 shows the Vsg-Id characteristics for different back gate voltages: specifically, the Vsg-Id characteristics with source-back gate voltages Vsb of −8 V, −4 V, 0 V, 4 V, 8 V, and 12 V. The source-back gate voltage Vsb of the drive transistor 173 indicates a voltage at the source electrode relative to a voltage at the back gate electrode in the drive transistor 173, and a positive value is obtained when the voltage at the source electrode is higher than the voltage at the back gate electrode while a negative value is obtained when the voltage at the source electrode is lower than the voltage at the back gate electrode.

The Vsg-Id characteristics shown in FIG. 3 reveals that Id differs depending on Vsb even when Vsg is constant. For example, assume that the drive transistor 173 is non-conducting when the drain current Id is equal to or less than 100 pA, and the drive transistor 173 is conducting when the drain current Id is 1 μA or more. In the case of Vsg=6 V and Vsb=−8 V, for example, the drive transistor 173 is non-conducting because Id is equal to or less than 100 pA. Likewise, in the case of Vsb=4 V, 8 V, or 12 V even with Vsg=6 V, the drive transistor 173 is conducting because Id is no less than 1 μA.

On the other hand, in the case of Vsb=−8 V, −4 V, or 0 V with Vsg=2 V, the drive transistor 173 is non-conducting because Id is no more than 100 pA. Likewise, in the case of Vsb=12 V even with Vsg=2 V, the drive transistor 173 is conducting because Id is no less than 1 μA.

The drive transistor 173 thus undergoes the transition between conducting and non-conducting according to Vsb even when Vsg is constant. That is, the threshold voltage of the drive transistor 173 changes according to Vsb. Specifically, the absolute value of the threshold voltage becomes higher as Vsb decreases. Thus, even when the source-gate voltage is constant, the drive transistor 173 undergoes the transition between conducting and non-conducting according to the back gate pulses BG (1) to BG (n) which are provided from the bias voltage control circuit 130 via the bias lines 165.

It is to be noted that the amount of current based on which it is determined whether the drive transistor 173 is conducting or non-conducting is defined depending on a circuit into which the drive transistor 173 is incorporated, and is thus not limited to the above example. Specifically, the state where the drive transistor 173 is conducting indicates a state where a drain current corresponding to the maximum gradation level can be provided when the source-gate voltage of the drive transistor 173 corresponds to the maximum gradation level. On the other hand, the state where the drive transistor 173 is non-conducting indicates a state where the drain current is equal to or less than an allowable current when the source-gate voltage of the drive transistor 173 corresponds to the minimum gradation level.

The allowable current is a drain current at the minimum value with which no voltage drop will occur in the power lines 162. In other words, even when the allowable current flows through the luminescent pixel 170, the amount of the allowable current is sufficiently small so that a voltage drop occurring in the power lines 162 is sufficiently small and thus does not cause a problem.

The following describes a determination on values of high level voltages and low level voltages of the back gate pulses BG (1) to BG (n) which are provided from the bias voltage control circuit 130.

The drive transistor 173 of the luminescent pixel 170 requires the following two conditions.

(Condition i) The luminescent element 175 is supplied with a drain current corresponding to the maximum gradation level when producing luminescence with the maximum gradation level.

(Condition ii) The luminescent pixel 175 is supplied with the drain current equal to or less than the allowable current when a signal voltage is written.

For example, assume that the drain current corresponding to the maximum gradation level is 3 μA and the allowable current during a writing period is 100 pA.

The following describes the determination on values of high level voltages and low level voltages of the back gate pulses BG (1) to BG (n) using the Vsg-Id characteristics shown in FIG. 3.

First, Vsb=8 V is selected as characteristics of the source-back gate voltage for producing luminescence.

Next, the source-gate voltage for producing luminescence with the maximum gradation level is determined. Specifically, since the drain current Id corresponding to the maximum gradation level is 3 μA, the selection of Vsb=8 V as above leads to Vsg=5.6 V.

Next, the source-back gate voltage Vsb at which the drain current Id is equal to or less than the allowable current in writing of the signal voltage is selected. It is to be noted that no matter what signal voltage corresponding to any one of the gradation levels is written in the luminescent pixel 170, the drain current Id is required to be equal to or less than the allowable current. The luminance of the luminescent element 175 becomes higher as the voltage held by the capacitor 174 becomes larger. Thus, the drain current Id must be equal to or less than the allowable current even when the capacitor 174 holds a voltage that corresponds to a signal voltage corresponding to the maximum gradation level. For example, when the signal voltage corresponding to the maximum gradation level is written in the luminescent pixel 170, the voltage held by the capacitor 174 is the above-mentioned source-gate voltage of the drive transistor 173 at which luminescence is produced with the maximum gradation level, that is, 5.6 V.

With Vsg=5.6 V, the source-back gate voltage Vsb at which the drain current Id is equal to or less than 100 pA is defined by Vsb≤−4 V. Thus, Vsb=−4 V is selected as the source-back gate voltage Vsb for writing the signal voltage.

As above, the source-back gate voltage for producing luminance is determined as Vsb=8 V and the source-back gate voltage for writing the signal voltage is determined as Vsb=−4 V.

The back gate voltage of the drive transistor 173 is obtained by subtracting the source-back gate voltage from the source voltage. That is, Vb=Vs−Vsb. This equation is represented also as Vb=Vdd−Vsb because Vs=Vdd.

While luminescence is produced, Vsb=8 V as mentioned above makes the equation Vb=15-8, thus Vb=7 V.

On the other hand, while the signal voltage is written, Vsb=−4 V as mentioned above makes the equation Vb=15−(−4), thus Vb=19 V.

Figure 4B:
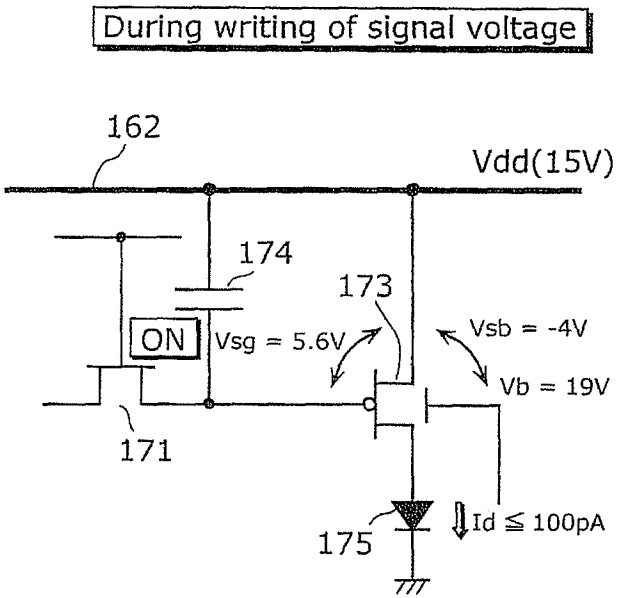
FIG. 4B is a diagram schematically showing a state of a luminescent pixel in which a signal voltage is being written.
Figure 4A:
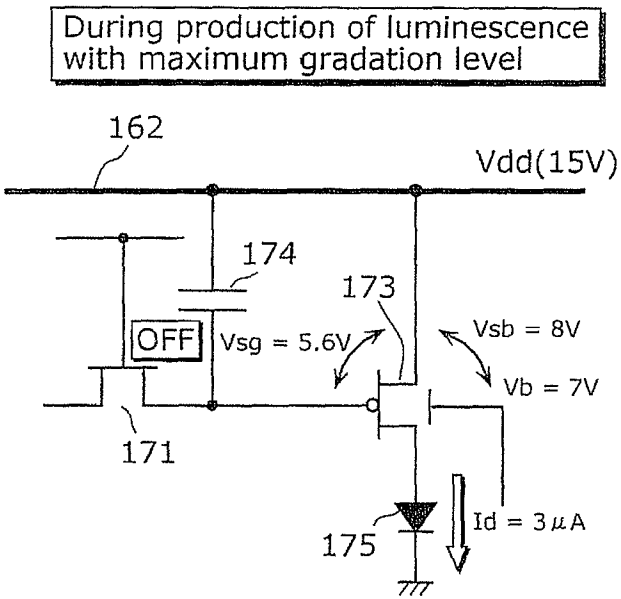
FIG. 4A is a diagram schematically showing a state of a luminescent pixel which is producing luminescence with the maximum gradation level.

FIG. 4A is a diagram schematically showing a state of the luminescent pixel 170 which is producing luminescence with the maximum gradation level. FIG. 4B is a diagram schematically showing a state of the luminescent pixel 170 in which a signal voltage is being written.

As shown in FIG. 4A, while luminescence is produced with the maximum gradation level, Vb=7V and thus Vsb=8V are set so that the drain current Id of 3 μA corresponding to the maximum gradation level is provided to the luminescent element 175.

On the other hand, as shown in FIG. 4B, while a signal voltage is written, Vb=19V and thus Vsb=−4 V are set so that the drain current can be equal to or less than the allowable current even when the signal voltage corresponding to the maximum gradation level is written. This means that no voltage drop occurs in the power line 162 while a signal voltage is written.

The organic EL display device 100 configured as above includes the trunk power line 190 disposed on the periphery of the display unit 180 and through which the predetermined fixed voltage Vdd is provided to the display unit 180, and the multiple power lines 162 which branch from the trunk power line 190 and extend along the multiple scan lines 164 so that adjacent ones of the power lines 162 are separate from one another in the display unit 180. As each of the multiple power lines 162 is thus separate from an adjacent one of the power lines 162 in the display unit 180, the voltage of the power line 162 for a given row of the luminescent pixels 170 in which a signal voltage is to be written will not be influenced by a voltage drop in the power line 162 for the luminescent pixels 170 which are adjacent to the given row and are producing luminescence.

With this, in the present embodiment, a predetermined bias voltage is provided to the back gate electrode, thereby placing the drive transistor 173 in a non-conducting state, and then a signal voltage is provided to the first electrode of the capacitor 174 with the drive transistor 173 in the non-conducting state. By so doing, the signal voltage is provided to the first electrode of the capacitor 174 with the drain current suspended, which can prevent a voltage drop which occurs in the power line 162 due to the drain current flowing through the luminescent element during the period for which the signal voltage is provided. Accordingly, it is possible to prevent the voltage of the second electrode of the capacitor 174 from fluctuating during the period for which the signal voltage is provided, and thus possible to maintain the capacitor 174 at a desired voltage. As a result, it is possible to prevent variations in luminance that are due to a voltage drop in the power line 162 for the luminescent pixel 170 in which the signal voltage is being written.

In the present embodiment, the back gate electrode is used as a switch for causing the transition between conducting and non-conducting states.

In other words, the bias voltage control circuit 130 controls the threshold voltage of the drive transistor 173 with the back gate pulses BG (1) to BG (n) which are provided to the back gate electrode via the bias line 165. Specifically, the bias voltage control circuit 130 provides such back gate pulses BG (1) to BG (n) that stop the drain current of the drive transistor 173 while the write drive circuit 110 writes a signal voltage at the first electrode of the capacitor 174 through the data line 166 by placing the scan transistor 171 in the conducting state. In the above, stopping the drain current of the drive transistor 173 indicates that the drain current becomes equal to or less than the allowable current.

This means that the voltage of the back gate pulses BG (1) to BG (n) at which the drain current of the drive transistor 173 stops is a voltage which makes the absolute value of the threshold voltage of the drive transistor 173 higher than the source-gate voltage of the drive transistor 173 during the period for which a signal voltage is written. The voltage of the back gate pulses BG (1) to BG (n) at which the drain current of the drive transistor 173 stops may therefore be referred to as bias voltage hereinbelow.

The organic EL display device 100 according to the present embodiment is capable of causing the transition of the drive transistor 173 between conducting and non-conducting states by the back gate pulses BG (1) to BG (n) which are provided from the bias voltage control circuit 130. In other words, as the transition of the drive transistor 173 between the conducting and non-conducting states is controlled through control of the bias voltage to be provided, the back gate electrode can be used as a switching element. This eliminates the need of providing another switching element for cutting the drive current off during the period for which a signal voltage is written. As a result, it is possible to simplify the circuitry design of the luminescent pixel 170 and thereby reduce the production cost.

Next, operations of the above organic EL display device 100 are described.

Figure 5:
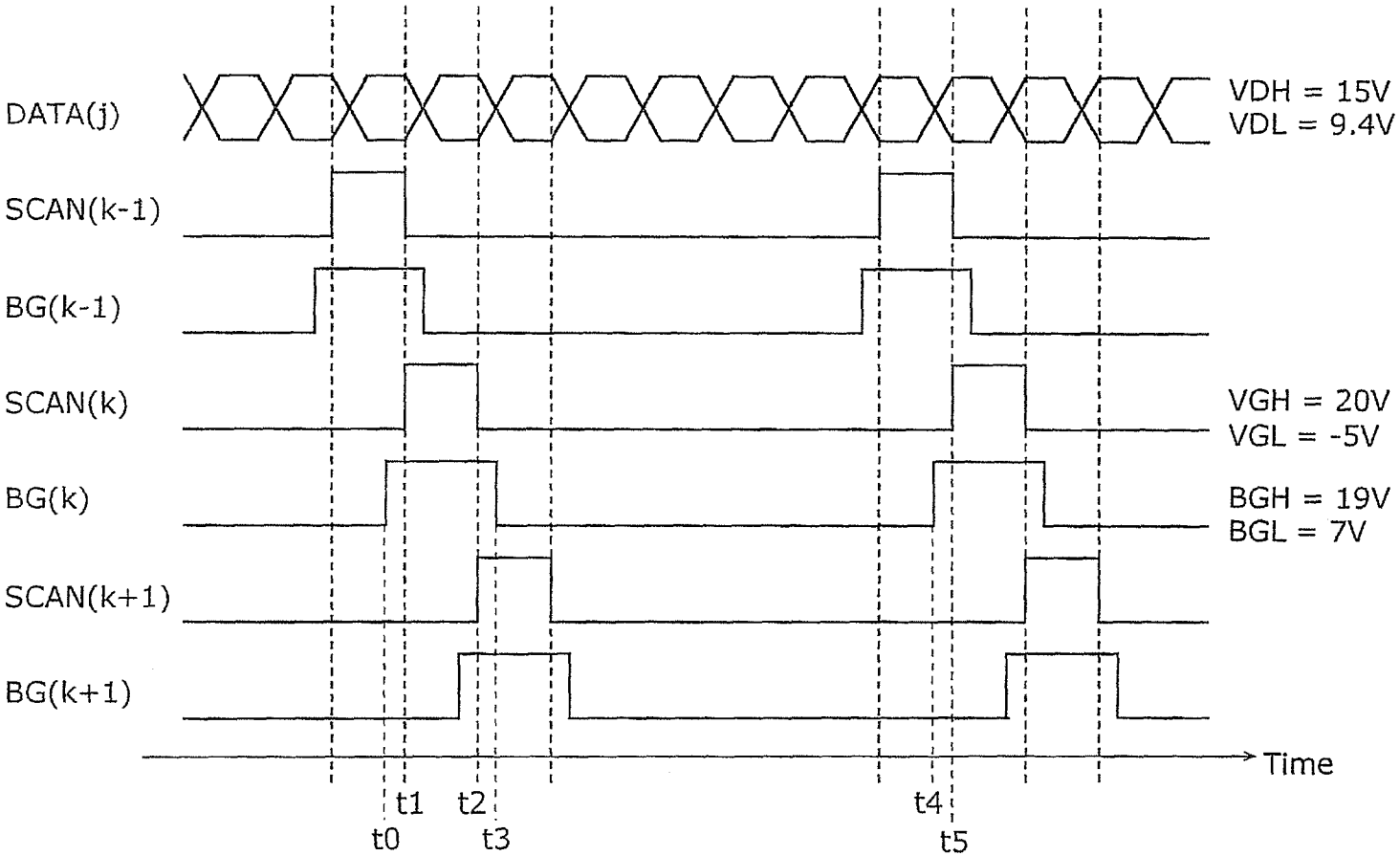
FIG. 5 is a timing chart showing operations of the organic EL display device.

FIG. 5 is a timing chart showing the operations of the organic EL display device 100 according to the first embodiment, and specifically, it mainly shows operations of the luminescent pixel 170 located in the "k"-th row and "j"-th column shown in FIG. 2. In FIG. 5, the horizontal axis represents time, and the vertical axis represents, in the order from top, a data line voltage DATA (j) which is provided to the data line 166 for the luminescent element 170 in the "j"-th column, a scan pulse SCAN (k−1) which is provided to the scan line 164 for the luminescent element 170 in the "k−1"-th row, a back gate pulse BG (k−1) which is provided to the bias line 165 for the luminescent element 170 in the "k−1"-th row, and furthermore, a scan pulse SCAN (k), a back gate pulse BG (k), a scan pulse SCAN (k+1), and back gate pulse BG (k+1) which are provided to the respective luminescent pixels in the "k"-th and "k+1"-th rows.

Assume, for example, that a data line voltage VDL corresponding to the signal voltage with the maximum gradation level is 9.4 V, and the data line voltage VDH corresponding to the signal voltage with the minimum gradation level is 15 V. In addition, assume that the scan pulses SCAN (1) to SCAN (n) have a high level voltage VGH of 20 V and a low level voltage VGL of −5 V, for example. Furthermore, as determined with reference to FIG. 3, assume that the back gate pulses BG (1) to BG (n) have a high level voltage BGH of 19 V and a low level voltage BGL of 7 V.

Before time t0, the scan pulse SCAN (k) and the back gate pulse BG (k) are at low level, which means that the luminescent pixels 170 in the "k"-th row produce luminescence according to a signal voltage obtained in the last frame period.

Next, at time t0, the back gate pulse BG (k) transits from low level to high level, which increases the back gate voltage of the drive transistor 173 from Vb=7 V to Vb=19 V. That is, the threshold voltage of the drive transistor 173 is set such that even when the signal voltage corresponding to the maximum gradation level is written in the luminescent pixel 170, the drain current of the drive transistor 173 remains no more than the allowable current. In other words, the absolute value of the threshold voltage of the drive transistor 173 is set to be higher than the voltage which is held by the capacitor 174 in the case where the signal voltage corresponding to the maximum gradation level is written in the luminescent element 170.

Next, at time t1, the scan pulse SCAN (k) transits from low level to high level, which switches the scan transistor 171 on. This allows conduction between the data line 166 and the first electrode of the capacitor 174, with the result that the data line voltage DATA (j) is provided to the first electrode of the capacitor 174. The second electrode of the capacitor 174, which is connected to the power line 162, is supplied with the fixed voltage Vdd (15V).

For example, when the data line voltage DATA (j) is 9.4 V, the source-back gate voltage is Vsb=−4 V and the source-gate voltage is Vsg=5.6 V as shown in FIG. 4B. In this case, the drain current Id corresponding to Vsg=5.6 V is 100 pA with reference to the Vsg-Id characteristics of Vsb=−4 V as shown in FIG. 3. Thus, the drain current Id is equal to or less than the allowable current, so that a voltage drop in the power line 162 can be sufficiently prevented during the writing period. This allows the capacitor 174 to hold a voltage which corresponds to the signal voltage, without influence of a voltage drop in the power line 162.

Next, at time t2, the scan pulse SCAN (k) transits from high level to low level, which switches the scan transistor 171 off. Consequently, the capacitor 174 holds the voltage applied immediately before the time t2. This means that the capacitor 174 holds the voltage which corresponds to the signal voltage, without influence of a voltage drop in the power line 162.

As seen from the above, the period from time t1 to time t2 is a period for which a signal voltage is written. In this period for which a signal voltage is written, the back gate pulse BG (k) stays at high level, which keeps the drain current Id of the drive transistor 173 equal to or less than the allowable current even when the first electrode of the capacitor 174 is supplied with the signal voltage corresponding to the maximum gradation level. Thus, in the state where the drain current Id is suspended, the capacitor 174 holds the voltage corresponding to the signal voltage, which makes it possible to prevent variations in luminance that are due to a decrease in voltage in the power line 162 during the period for which a signal voltage is written. Specifically, while a signal voltage is written in the luminescent pixels 170 in the "k"-th row, variations in luminance that are due to a voltage drop in the power line 162 corresponding to the luminescent pixels 170 in the "k"-th row can be prevented.

A voltage drop in the power line 162 occurs when a current flows from the power line 162 to the luminescent pixel 170. Thus, as described above, the drain current Id is set to be equal to or less than the allowable current so that the current which flows from the power line 162 to the luminescent pixels 170 will substantially stop, thereby preventing the voltage drop in the power line 162.

The multiple power lines 162 included in the organic EL display device 100 are provided for the respective rows of the multiple luminescent pixels 170 arranged in a matrix, and each branch from the trunk power line 190.

In the meantime, since the luminescent element 175 produces luminescence by the drain current Id of the drive transistor 173, a voltage drop occurs in the power line 162 corresponding to the luminescent pixel 170 which is producing luminescence (which power line 162 will be hereinafter referred to as the power line 162 in the luminescence-producing row).

In the organic EL display device 100, however, the power line 162 corresponding to the row of the luminescent pixels 170 to which a signal voltage is being written (which power line 162 will be hereinafter referred to as the power line 162 in the writing row) is provided separately from the power line 162 in the luminescence-producing row. The power lines 162 in the writing rows therefore have uniform voltages. In other words, there is no variations in the voltage of the power lines 162 in the writing rows.

The organic EL display device 100 according to the present embodiment is therefore capable of preventing variations in luminance that are due to a voltage drop in the power line 162 corresponding to the luminescent pixel 170 in which a signal voltage is being written.

Because the signal voltage decreases as the gradation level increases, it is obvious that the drain current Id of the drive transistor 173 is equal to or less than the allowable current even when the signal voltage corresponding to a gradation level other than the maximum gradation level is provided to the first electrode of the capacitor 174.

Next, at time t3, the back gate pulse BG (k) transits from high level to low level, with the result that the back gate voltage of the drive transistor 173 decreases from Vb=19 V to Vb=7 V. The absolute value of the threshold voltage of the drive transistor 173 therefore becomes lower, so that the drain current Id corresponding to the voltage held by the capacitor 174, which voltage corresponds to the signal voltage, is provided to the luminescent element 175 which thereby starts to produce luminescence. For example, in the case where the signal voltage is 9.4 V, the voltage held by the capacitor 174, which is the difference between the signal voltage and the fixed voltage Vdd (e.g., 0 V), is 5.6 V, and with reference to FIG. 3, the drain current Id is 3 μA, which causes the luminescent element 175 to produce luminescence with a luminance corresponding to the maximum gradation level.

After this, in the period from time t3 to t4, the back gate pulse BG(k) stays at low level, which allows the luminescent element 175 to keep producing luminescence. As seen from the above, the period from time t3 to time t4 is a period for which luminescence is produced.

Next, at time t5, as in the case of time t1, the scan pulse SCAN (k) transits from low level to high level, which switches the scan transistor 171 on. This allows conduction between the data line 166 and the first electrode of the capacitor 174, with the result that the data line voltage DATA (j) is provided to the first electrode of the capacitor 174.

The above-described period from time t1 to time t5 corresponds to one frame period of the organic EL display device 100, and the same operations as those from time t1 to time t5 are repeated after time t5.

As above, the organic EL display device 100 sets the back gate pulse BG (k) at high level to make the drain current of the drive transistor 173 equal to or less than the allowable current, and sets, in this state, the fixed voltage Vdd=15V, at which no voltage drops occurs, for the second electrode of the capacitor 174, and furthermore provides the signal voltage to the first electrode of the capacitor 174. By so doing, the signal voltage is provided to the first electrode of the capacitor 174 with the drain current suspended, which can prevent a voltage drop which occurs in the power line 162 due to the drain current Id flowing during the period for which the signal voltage is provided. As a result, in the period from time t3 to time t4 for which luminescence is produced, the luminescent element 170 can produce luminescence with a desired luminance. It is to be noted that when the drain current of the drive transistor 173 is equal to or less than the allowable current, the drive transistor 173 is substantially non-conducting.

As above, the organic EL display device 100 according to the present embodiment includes: the display unit 180 including the plurality of luminescent pixels 170 arranged in a matrix, the luminescent pixels 170 each including the luminescent element 175 and the drive transistor 173 for controlling a current flow to the luminescent element 175; the plurality of scan lines 164 for providing a signal for scanning the luminescent pixels included in the display unit 180; the plurality of data lines for providing a signal voltage to the luminescent pixels 170 included in the display unit 180; the trunk power line 190 disposed on a periphery of the display unit 180, for providing a predetermined fixed voltage Vdd to the display unit 180; the DC power supply 150 which provides, to the trunk power line 190, the predetermined fixed voltage Vdd that is an external input; the plurality of power lines 162 which correspond to the respective scan lines 164, branching from the trunk power line 190 so as to be separate from one another in the display unit 180, the power lines 162 each extending along a corresponding one of the scan lines 164 and being electrically connected to one of the source electrode and the drain electrode of a corresponding one of the drive transistors 173; and the power line 161 electrically connected to the other one of the source electrode and the drain electrode of the drive transistor 173, wherein each of the luminescent pixels 170 includes: the capacitor 174 having the first electrode connected to the gate electrode of the drive transistor 173 and the second electrode connected to the source electrode of the drive transistor 173; and the scan transistor 171 having one terminal connected to the data line 166 and the other terminal connected to the first electrode of the capacitor 174, and selecting conduction or non-conduction between the data line 166 and the first electrode of the capacitor 174, and the drive transistor 173 includes a back gate electrode to which the high level voltage BGH of the back gate pulses BG (1) to BG (n) is provided to control the drive transistor 173 between the conducting state and the non-conducting state, the organic EL display device further comprising: the bias line 165 for providing the high level voltage BGH of the back gate pulses BG (1) to BG (n) to the back gate electrode; and the write drive circuit 110 and the bias voltage control circuit 130 which control the scan transistor 171 and the high level voltage BGH of the back gate pulses BG (1) to BG (n) that are provided to the back gate electrode, wherein the high level voltage BGH of the back gate pulses BG (1) to BG (n) is provided so that the absolute value of the threshold voltage of the drive transistor 173 is larger than a voltage between the gate electrode and the source electrode, and the write drive circuit 110 and the bias voltage control circuit 130 (i) provide the high level voltage BGH of the back gate pulses BG (1) to BG (n) to the back gate electrode so that the absolute value of the threshold voltage of the drive transistor 173 is larger than the voltage between the gate electrode and the source electrode, to place the drive transistor 173 in the non-conducting state (time t0), and (ii) provide the signal voltage to the first electrode of the capacitor 174 when the drive transistor 173 is in the non-conducting state, by placing the scan transistor 171 in the conducting state within a period (time t0 to time t3) during which the high level voltage BGH of the back gate pulses BG (1) to BG (n) is provided.

As each of the multiple power lines 162 is thus separate from an adjacent one of the power lines 162 in the display unit 180, the voltage of the power line 162 for a given row of the luminescent pixels 170 in which a signal voltage is to be written will not be influenced by a voltage drop in the power line 162 for the luminescent pixels 170 which are adjacent to the given row and are producing luminescence.

With this, in the present embodiment, the high level voltage BGH of the back gate pulses BG (1) to BG (n) is provided to the back gate electrode, which places the drive transistor 173 in a non-conducting, and then a signal voltage is provided to the first electrode of the capacitor 174 with the drive transistor 173 in the non-conducting state. By so doing, the signal voltage is provided to the first electrode of the capacitor 174 with the drive current Id suspended, which can prevent a voltage drop which occurs in the power line 162 due to the drive current Id flowing through the luminescent element 175 while the signal voltage is provided. Accordingly, it is possible to prevent the voltage of the second electrode of the capacitor 174 from fluctuating during the period for which the signal voltage is provided, and thus possible to maintain the capacitor 174 at a desired voltage. As a result, it is possible to prevent variations in luminance which are due to a voltage drop in the power line 162 for the luminescent pixel 170 in which the signal voltage is being written.

In the present embodiment, the back gate electrode is used as a switch for causing the transition of the drive transistor 173 between conducting and non-conducting states. The high level voltage BGH of the back gate pulses BG (1) to BG (n) is provided so that the absolute value of the threshold voltage of the drive transistor 173 is larger than the voltage between the gate electrode and the source electrode of the drive transistor 173. As the transition of the drive transistor 173 between the conducting and non-conducting states is controlled through control of the high level voltage BGH of the back gate pulses BG (1) to BG (n) which are to be provided, the back gate electrode can be used as a switch element. This eliminates the need of providing another switching element for cutting the drive current Id off during the period for which the signal voltage is written.

Thus, in the present embodiment, during the period for which the signal voltage is written, not only one power line 162 is separate from another power line 162 for the adjacent row of the luminescent pixels in the display unit 180, but also the drive transistor 173 is provided with an additional function as a switch by using its back gate electrode. This eliminates the need of providing a switching element for cutting the drive current Id off during the period for which the signal voltage is written, which makes it possible to simplify the structure of each of the luminescent pixels 170 and thereby reduce the production cost of the organic EL display device 100.

The high level voltage BGH of the back gate pulses BG (1) to BG (n) which is provided so that the absolute value of the threshold voltage of the drive transistor 173 is larger than the voltage between the gate electrode and the source electrode of the drive transistor 173 indicates a voltage which is set so that the absolute value of the threshold voltage of the drive transistor 173 is larger than the source-gate voltage Vsg of the drive transistor 173 when the gate electrode of the drive transistor 173 is supplied with a predetermined signal voltage that is required to cause the luminescent element 175 in each of the luminescent pixels 170 to produce luminescence with the maximum gradation level. In sum, the high level voltage BGH of the back gate pulses BG (1) to BG (n) is a predetermined bias voltage.

In this case, setting the high level voltage BGH of the back gate pulses BG (1) to BG (n) in the back gate electrode of the drive transistor 173 allows the drive transistor 173 to have a threshold voltage of which absolute value is larger than the source-gate voltage Vsg of the drive transistor 173 with all the gradation levels for display. As a result, it is possible to stop the drain current Id by reliably causing the transition of the drive transistor 173 to the non-conducting state when a signal voltage is being written.

Furthermore, in the organic EL display device 100, from time t1 to time t2 in FIG. 5, a signal voltage is provided to the first electrode of the capacitor 174 and then, at time t2, the scan transistor 171 undergoes the transition to non-conduction. Subsequently, at time t3, the low level voltage (BGL=7 V) of the back gate pulse BG (k) lower than the high level voltage (BGH=19 V) of the back gate pulse BG (k) is provided to the back gate electrode so that the absolute value of the threshold voltage of the drive transistor 173 becomes lower than the source-gate voltage, which causes the transition of the drive transistor 173 to the conducting state, and the drain current Id corresponding to the voltage held by the capacitor 174 is allowed to flow to the luminescent element 175 and thereby causes it to produce luminescence.

Specifically, in the case where the drive transistor 173 is a P-type transistor as in the present embodiment, a signal voltage is provided to the first electrode of the capacitor 174, and the back gate electrode of the drive transistor 173 is then supplied with the low level voltage of the back gate pulse BG (k), which is a reverse bias voltage lower than the high level voltage of the back gate pulse BG (k) that is a predetermined bias voltage. This causes the transition of the drive transistor 173 from the non-conducting state to the conducting state, which allows the drain current Id corresponding to the voltage held by the capacitor 174 to flow to the luminescent element 175 and thereby causes the luminescent element 175 to start to produce luminescence.

In the present embodiment, the scan pulse SCAN (k) is at high level (time t1 to time t2) within the period (time t0 to time t3) when the back gate pulse BG (k) is at high level, but the period for which the back gate pulse BG (k) stays at high level may be the same as the period for which the scan pulse SCAN (k) stays at high level. In other words, the period for which the back gate electrode of the drive transistor 173 is supplied with the high level voltage of the back gate pulse BG (k) may be the same as the period for which the first electrode of the capacitor 174 is supplied with a signal voltage.

Variation of First Embodiment

The organic EL display device according to the present variation is almost the same as the organic EL display device 100 according to the first embodiment except that the scan line 164 and the bias line 165 are provided as a common control line.

The following specifically describes the variation of the first embodiment, especially differences thereof from the first embodiment, with reference to the drawings.

Figure 6:
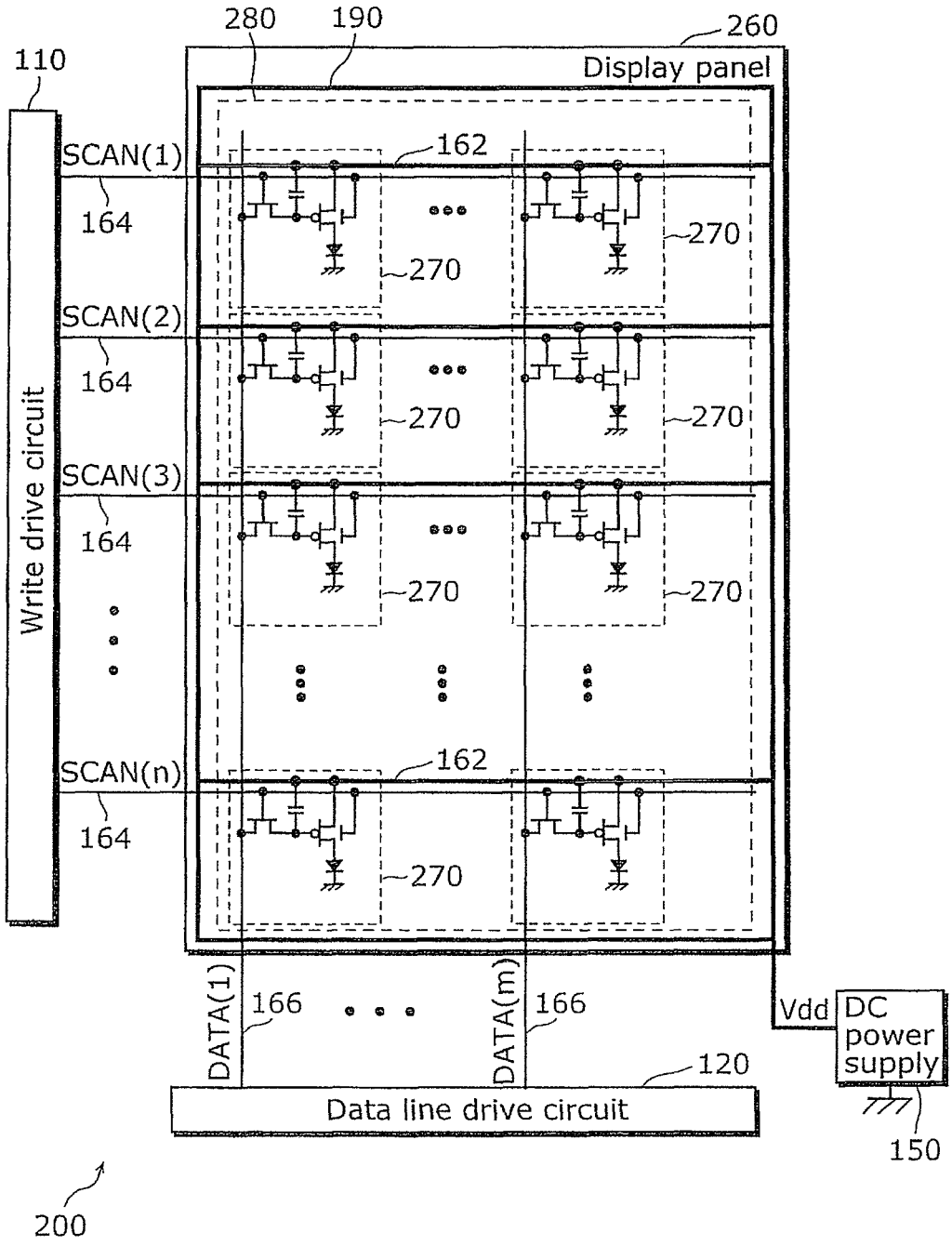
FIG. 6 is a block diagram showing a configuration of an organic EL display device according to a variation of the first embodiment.
Figure 7:
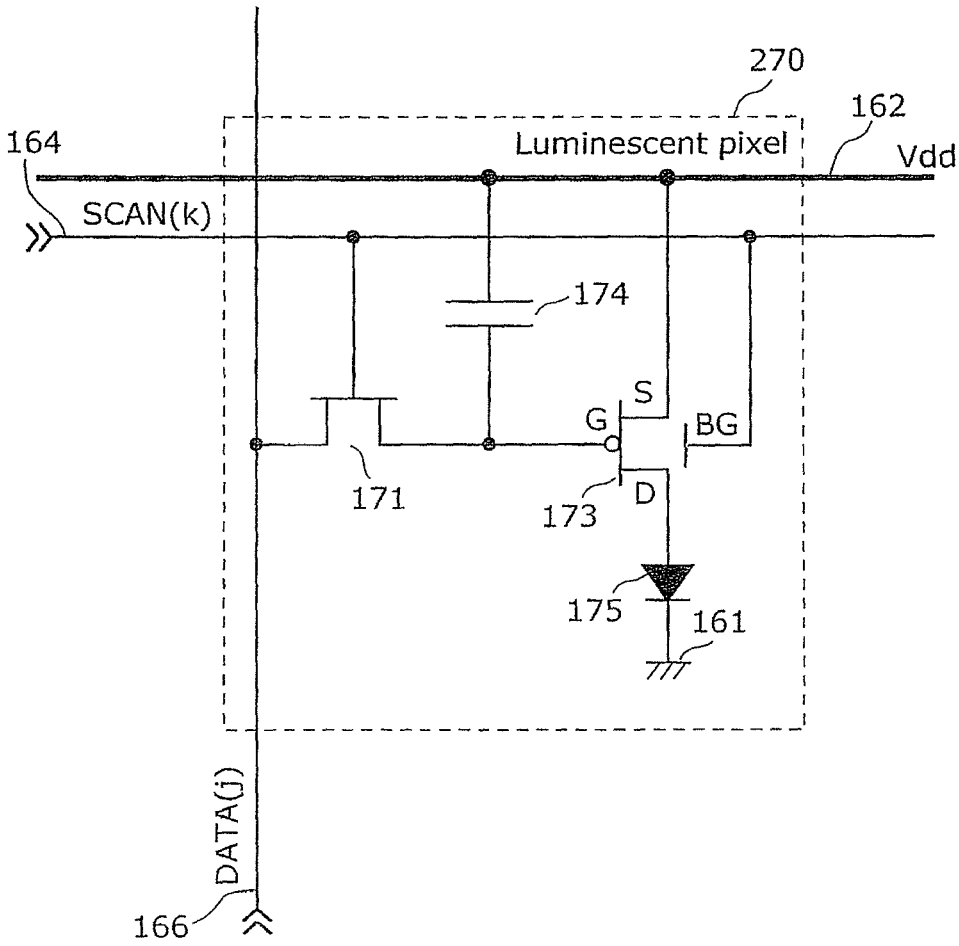
FIG. 7 is a circuit diagram showing a detailed circuitry design of a luminescent pixel.

FIG. 6 is a block diagram showing a configuration of the organic EL display device according to the present variation, and FIG. 7 is a circuit diagram showing a detailed circuitry design of a luminescent pixel included in the organic EL display device according to the present variation.

As shown in FIG. 6, unlike the organic EL display device 100 according to the first embodiment shown in FIG. 1, an organic EL display device 200 according to the present variation does not include the bias voltage control circuit 130 and the bias lines 165, and includes luminescent pixels 270 instead of the luminescent pixels 170. Furthermore, the organic EL display device 200 includes, instead of the display panel 160, a display panel 260 that includes a display unit 280 in which the multiple luminescent pixels 270 are arranged.

As shown in FIG. 7, in each of the luminescent pixels 270, unlike the luminescent pixel 170, the back gate electrode of the drive transistor 173 is connected to the scan line 164. This means that the organic EL display device 200 according to the present variation, which requires no bias lines 165 unlike the display device 100 according to the first embodiment, has the reduced number of wiring channels, thus allowing for a simplified circuitry design.

Figure 8:
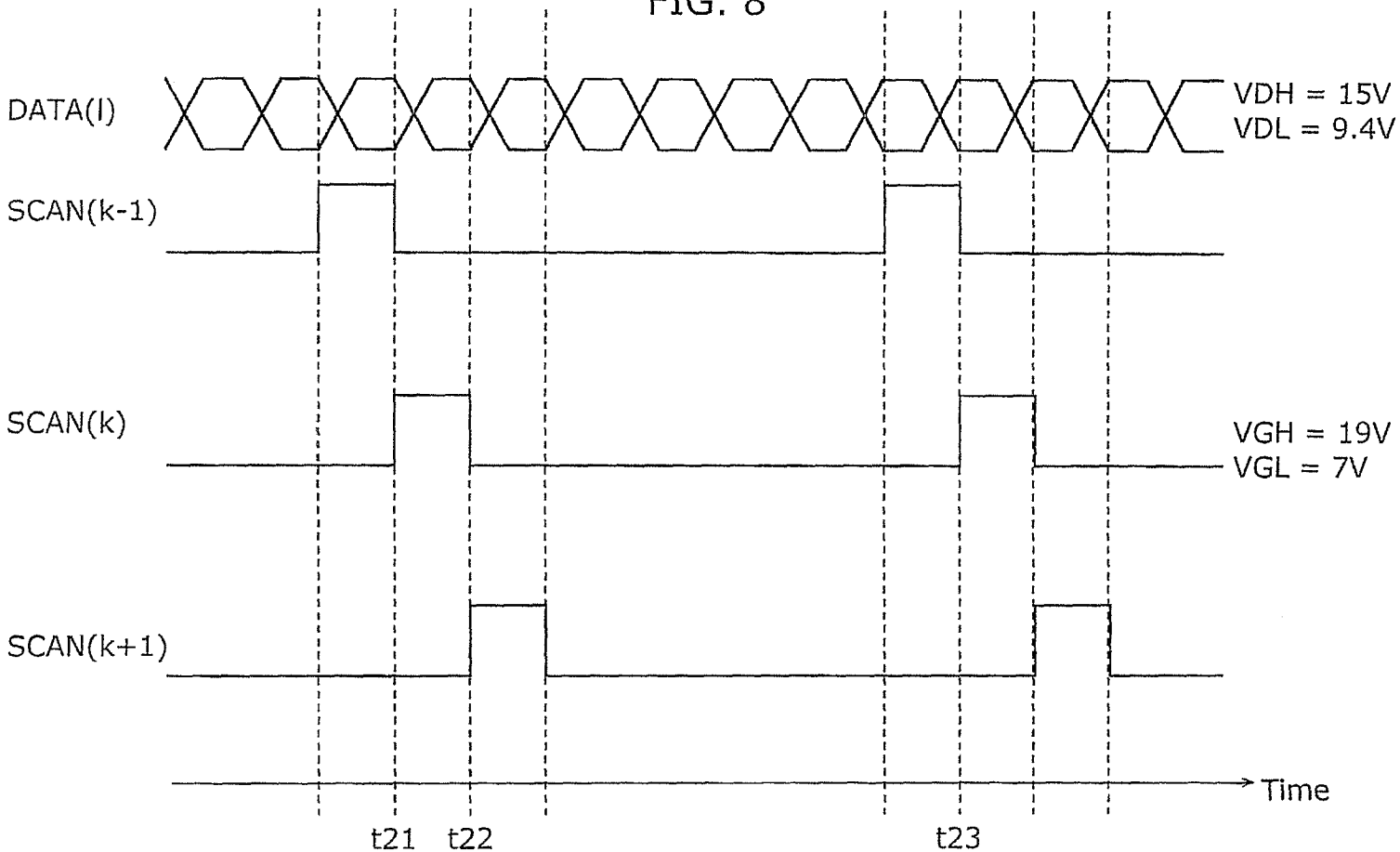
FIG. 8 is a timing chart showing operations of the organic EL display device.

FIG. 8 is a timing chart showing operations of the organic EL display device 200 according to the variation of the first embodiment. Specifically, it mainly shows operations of the luminescent pixel 270 located in the "k"-th row and "j"-th column shown in FIG. 6.

First, at time t21, the scan pulse SCAN (k) transits from low level to high level, which switches the scan transistor 171 on.

Assume that the scan pulse SCAN (k) has a low level voltage VGL of 7 V and a high level voltage VGH of 19 V. Accordingly, the transition of the scan pulse SCAN (k) from low level to high level increases the back gate voltage of the drive transistor 173 from Vb=7 V to Vb=19 V. That is, the threshold voltage of the drive transistor 173 is set such that even when the signal voltage corresponding to the maximum gradation level is written in the luminescent pixel 270, the drain current of the drive transistor 173 remains no more than the allowable current. In other words, the high level voltage VGH of the scan pulse SCAN (k) is such a voltage that the absolute value of the threshold voltage of the drive transistor 173 becomes higher than the voltage which is held by the capacitor 174 in the case where the signal voltage corresponding to the maximum gradation level is written in the luminescent element 270.

In sum, unlike the organic EL display device 100 according to the first embodiment, the organic EL display device 200 according to the present variation does not include the bias lines 165 for setting the voltage at the back gate electrode of the drive transistor 173 to the predetermined bias voltage, but uses, as the predetermined bias voltage, the high level voltage VGH of the scan pulse SCAN (k) which is provided to the scan lines 164.

Next, at time t22, the scan pulse SCAN (k) transits from low level to high level, which switches the scan transistor 171 off.

As seen from the above, the period from time t21 to time t22 is a period for which a signal voltage is written. In this period for which a signal voltage is written, the voltage which is provided to the back gate electrode of the drive transistor 173 keeps being the high level voltage VGH of the scan pulse SCAN (k), which keeps the drain current Id of the drive transistor 173 equal to or less than the allowable current even when the first electrode of the capacitor 174 is supplied with the signal voltage corresponding to the maximum gradation level. As in the case of the organic EL display device 100 according to the first embodiment, the organic EL display device 200 according to the present variation is capable of preventing the voltage at the second electrode of the capacitor 174 from fluctuating during the period for which a signal voltage is written.

At time t22, the source-back gate voltage Vsb of the drive transistor 173 becomes 8 V, in the case where the low level voltage (VGL=7 V) of the scan pulse SCAN (k) is provided. As described in the first embodiment, when the luminescent element 175 is producing luminescence with the maximum gradation level, the source voltage of the drive transistor 173 is 15 V and therefore, the source-back gate voltage Vsb of the drive transistor 173 is 8 V. Accordingly, with the Vsg-Id characteristics shown in FIG. 3, it is possible to satisfy the conditions required in the drive transistor 173, namely, Condition i: the luminescent element 175 is supplied with a drain current corresponding to the maximum gradation level when producing luminescence with the maximum gradation level.

That is, in the organic EL display device 200 according to the present variation, the low level voltage VGL of the scan pulse SCAN (k) which is provided to the scan lines 164 is used as the back gate voltage for obtaining the source-back gate voltage at which the drain current Id corresponding to the maximum gradation level flows.

Next, at time t23, as in the case of time t21, the scan pulse SCAN (k) transits from low level to high level, which switches the scan transistor 171 on. In addition, the back gate voltage of the drive transistor 173 increases from Vb=7 V to Vb=19 V.

The above-described period from time t21 to time t23 corresponds to one frame period of the organic EL display device 200, and the same operations as those from time t21 to time t23 are repeated after time t23.

As above, in the organic EL display device 200 according to the present variation, the scan line 164 and the bias line 165 are provided as a common control line, unlike the organic EL display device 100 according to the first embodiment. Specifically, as compared to the first embodiment, the scan line 164 is connected further to the back gate electrode of the drive transistor 173. For this reason, the period for which the predetermined bias voltage (VGH=19 V) is provided to the back gate electrode of the drive transistor 173 is set to be the same as the period for which a signal voltage is provided to the first electrode of the capacitor 174.

Second Embodiment

An organic EL display device according to a present embodiment is almost the same as the organic EL display device 100 according to the first embodiment except that multiple voltage clamp units are provided to the respective power lines 162 so as to fix a voltage of each of the power lines 162 at a predetermined fixed level and that each of the power lines 162 therefore branches from the trunk power line 190 via a corresponding one of the voltage clamp units.

The following specifically describes the present embodiment, especially differences thereof from the first embodiment, with reference to the drawings.

Figure 9:
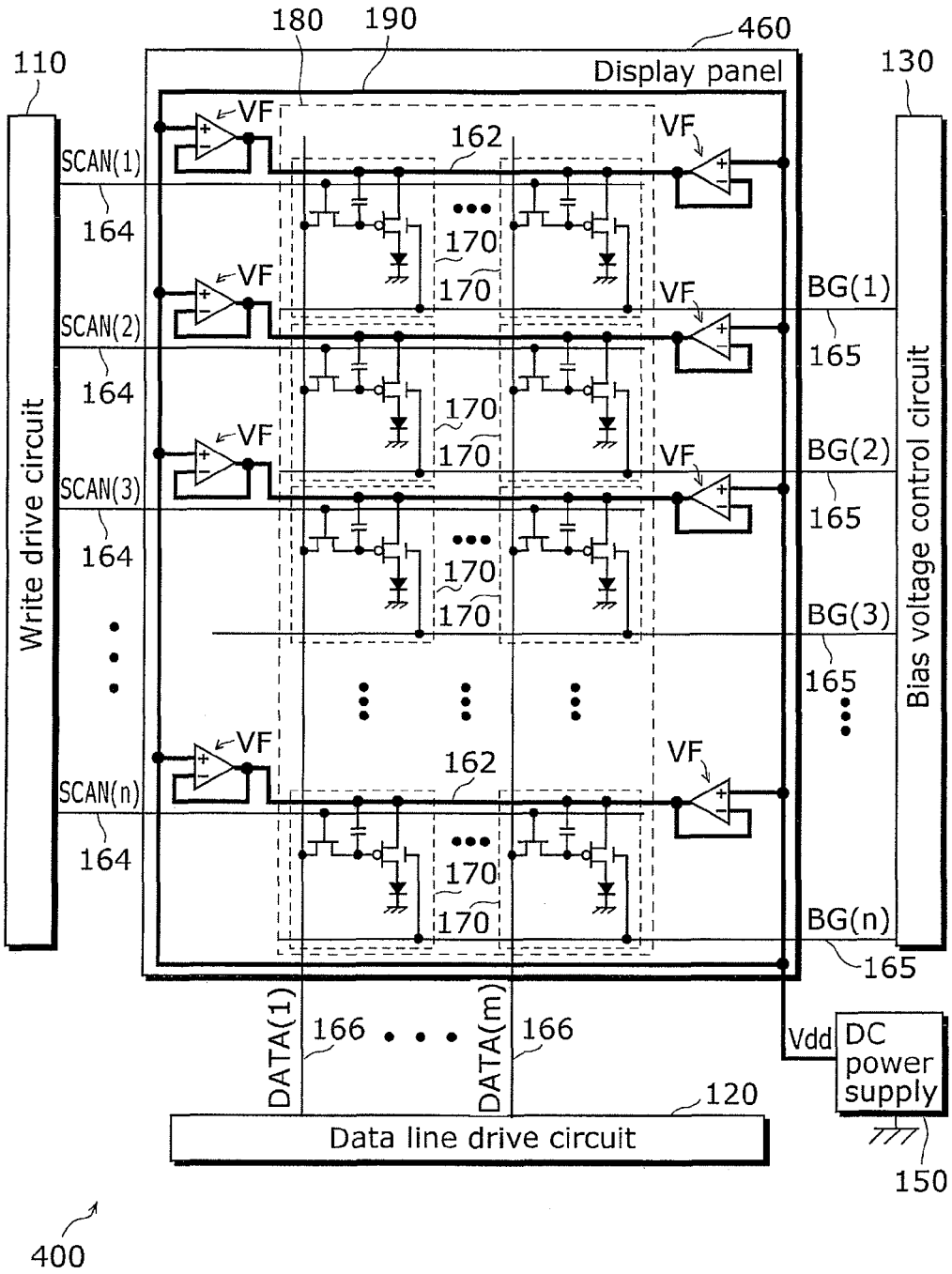
FIG. 9 is a block diagram showing a configuration of an organic EL display device according to the second embodiment.

FIG. 9 is a block diagram showing a configuration of the organic EL display device according to the second embodiment.

The organic EL display device 400 shown in FIG. 9 includes a display panel 460 instead of the display panel 160 as compared to the organic EL display device 100 according to the first embodiment.

As compared to the display panel 160, the display panel 460 further includes multiple voltage follower circuits VF provided in the respective power lines 162. Specifically, each of the power lines 162 branches from the trunk power line 190 via a corresponding one of the voltage follower circuits VF.

The voltage follower circuit VF is one example of the voltage clamp unit according to an implementation of the present invention, which fixes a voltage of the corresponding one of the power lines 162 at the predetermined fixed voltage Vdd. Specifically, the voltage follower circuit VF is composed of an operational amplifier having a non-inverting input terminal, an inverting input terminal, and an output terminal. This operational amplifier has the non-inverting input terminal connected to the trunk power line 190, and the output terminal connected to the corresponding one of the power lines 162 and further connected to the inverting input terminal.

The voltage follower circuit VF is an amplifier circuit having an amplification degree of 1 with a very low input impedance and a very high output impedance. The voltage follower circuit VF operates so that the voltage of the trunk power line 190 connected to the non-inverting input terminal of the operational amplifier and the voltage of the power line 162 connected to the output terminal of the operational amplifier become equal and that the voltage of the power line 162 is fixed at the predetermined fixed voltage Vdd that is the voltage of the trunk power line 190. In other words, even when the voltage of the power line 162 fluctuates, such fluctuation in voltage of the power line 162 does not transfer to the trunk power line 190. Consequently, even when a voltage of any one of the power lines 162 fluctuates, the voltage of the trunk power line 190 is the predetermined fixed voltage Vdd, which keeps the voltages of the other power lines 162 at the predetermined fixed voltage Vdd.

The following describes advantages of the organic EL display device 400 according to the present embodiment by way of comparison between the organic EL display device including no voltage follower circuits and the organic EL display device 400 including the voltage follower circuits VF.

Figure 10A:
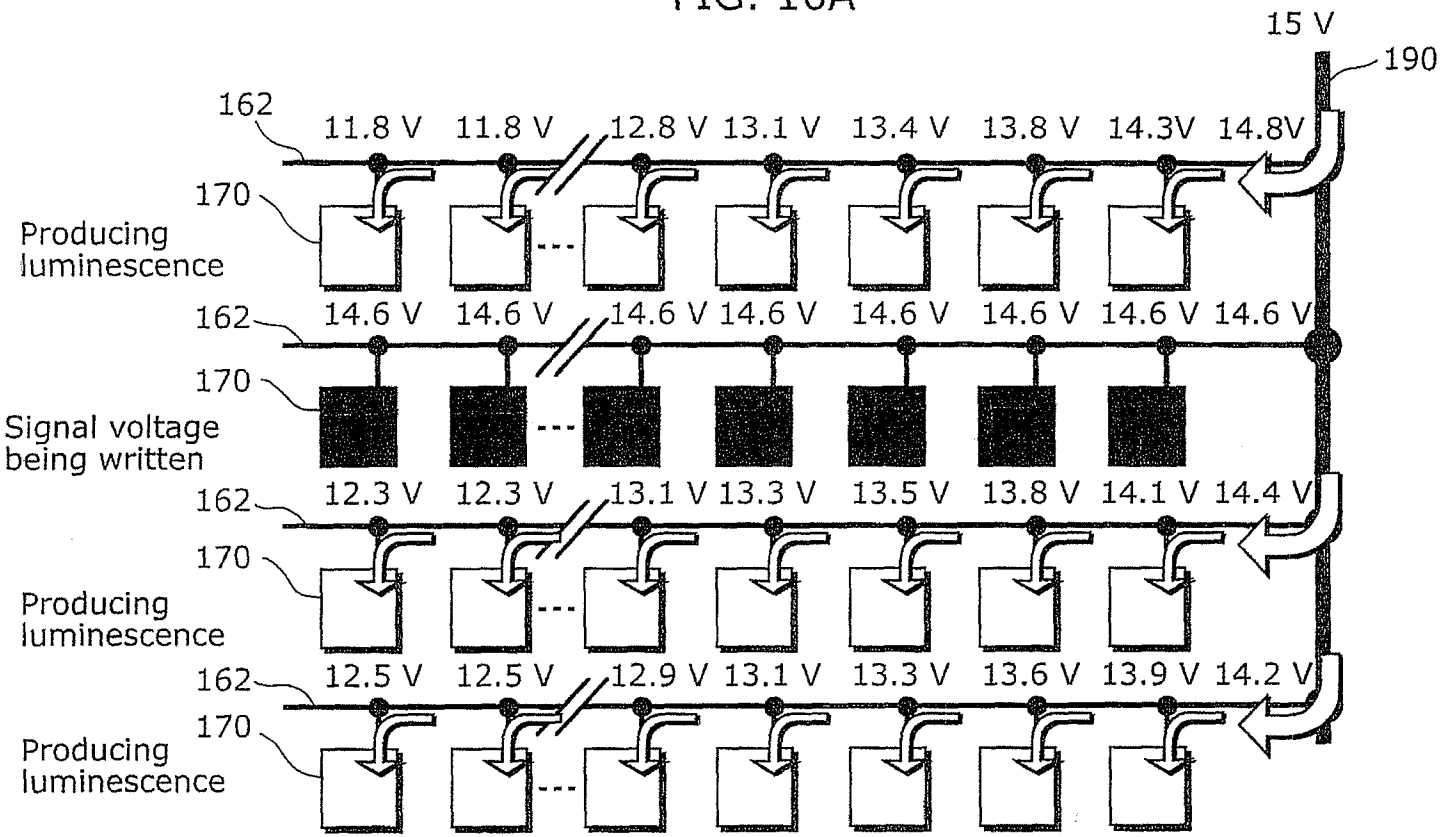
FIG. 10A schematically shows voltage and current in a display panel including no voltage follower circuit CF.
Figure 10B:
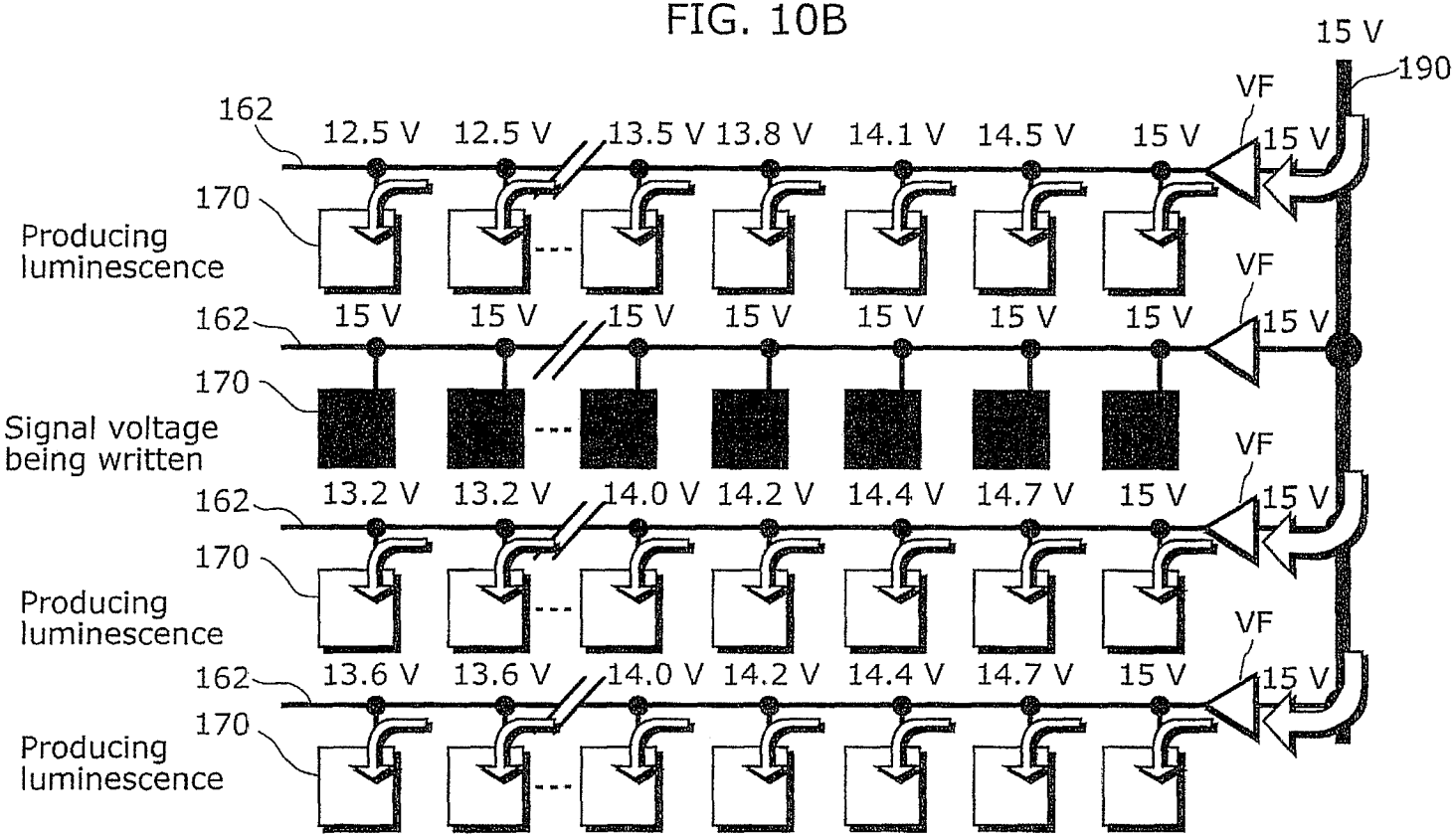
FIG. 10B schematically shows voltage and current in a display panel included in the organic EL display devices according to the second embodiment.

FIG. 10A schematically shows voltage and current in a display panel including no voltage follower circuit VF. FIG. 10B schematically shows voltage and current in a display panel including the voltage follower circuits VF. That is, FIG. 10B schematically shows voltage and current in the display panel 460 included in the organic EL display device 400 according to the present embodiment.

First, the voltage and current in the display panel including no voltage follower circuits as shown in FIG. 10A are described. Such a display panel is represented, for example, by the display panel 160 of the organic EL display device. 100 according to the first embodiment.

In the display panel of the organic EL display device 100 according to the first embodiment, the drain current Id of the drive transistor 173 flowing to the luminescent pixel 170 in which a signal voltage is being written is equal to or less than the allowable current. This means that the drain current Id substantially stops in the luminescent pixel 170 in which a signal voltage is being written.

Consequently, no voltage drop occurs in the power line 162 corresponding to the row of the luminescent pixels to which a signal voltage is being written.

On the other hand, to the luminescent pixel 170 which is producing luminescence, the current which corresponds to a luminance thereof flows. Thus, in the power line 162 corresponding to the row of the luminescent pixels which are producing luminescence, a voltage drop occurs due to the current corresponding to the luminance.

Such a voltage drop in the power line 162 corresponding to the row of the luminescent pixels which are producing luminescence has an impact on the voltage of the trunk power line 190. Specifically, at a position closer to the DC power supply 150 than to any of the power lines 162, the voltage of the trunk power line 190 is equal to the fixed voltage Vdd (15 V) which is supplied from the DC power supply 150, but the voltage drops as more power lines 162 branch from the trunk power line 190. As a result, the voltage at the branch point between the trunk power line 190 and the power line 162 corresponding to the row of the luminescent pixels in which a signal voltage is being written is, for example, 14.6 V which is different from the fixed voltage Vdd (15 V) supplied from the DC power supply 150.

In other words, in the case where each of the power lines 162 directly branches from the trunk power line 190, the drain current flows in the row of the luminescent pixels 170 which are producing luminescence, causing a voltage drop in the power lines 162 and thus causing a voltage drop on the branch point between the trunk power line 190 and the power line 162 corresponding to this row of the luminescent pixels. The voltage of the branch point between the trunk power line 190 and the power line 162 for a given row of the luminescent pixels in which a signal voltage is written may therefore fluctuate due to such a voltage drop. As a result, the voltage of the power line 162 for a given row of the luminescence pixels in which a signal voltage is written is uniform among the respective luminescent pixels 170 in this given row, but the voltage itself of the power line 162 changes to a level lower than the fixed voltage Vdd (15 V) of the DC power supply 150.

In contrast, as shown in FIG. 10B, in the display panel 460 of the organic EL display device 400 according to the second embodiment including the voltage follower circuits VF, a voltage drop in the power line 162 corresponding to the row of the luminescent pixels which are producing luminescence has no impact on the voltage of the trunk power line 190 owing to the voltage follower circuits VF. The voltage of the trunk power line 190 is therefore the fixed voltage Vdd which is supplied from the DC power supply 150, at any positions in the trunk power line 190. Accordingly, the voltage of the branch point between the trunk power line 190 and the power line 162 corresponding to the row of the luminescent pixels in which a signal voltage is written is the fixed voltage Vdd (15 V).

In other words, the voltage follower circuits VF hold the voltages of the respective power lines 162 at the predetermined fixed voltage Vdd, so that it is possible to prevent a voltage drop in the power line 162 for the given row of the luminescent pixels in which a signal voltage is written from influencing, via the trunk power line 190, the power line 162 for the row of the luminescent pixels which are producing luminescence.

The luminescent pixel 170 included in the display unit 180 is thus capable of producing luminescence with a desired luminance.

As above, as compared to the organic EL display device 100 according to the first embodiment, the organic EL display device 400 according to the present embodiment further includes the multiple voltage follower circuits VF which are provided to the respective power lines 162 so as to fix voltages of the respective power lines 162 at the predetermined fixed voltage Vdd, and each of the power lines 162 branches from the trunk power line 190 via a corresponding one of the voltage follower circuits VF.

This allows the organic EL display device 400 according to the present embodiment to fix, at the fixed voltage Vdd, the voltage of the power line 162 corresponding to the row of the luminescent pixels in which a signal voltage is being written, and therefore to cause each of the luminescent pixels 170 included in the display unit 180 to produce luminescence with a desired luminance.

In the configuration disclosed in Japanese Unexamined Patent Application Publication No. 2009-271320, for example, a dedicated driver is provided as means for applying a fixed voltage to a power line in writing of a signal voltage. In this case, it is necessary to switch between the period for which a predetermined fixed voltage is provided to multiple power lines by scanning them and the period for which a drive current is provided to luminescent pixels. The dedicated driver therefore requires a complicated circuit such as a shift register, which leads to an increase in cost.

Contrarily, in the organic EL display device 400 according to the present embodiment, the means for applying the fixed voltage Vdd to the power line 162 is made up of only the voltage follower circuits VF. Consequently, outputs of the voltage follower circuits VF can be a single value that is the fixed voltage Vdd, which means that the voltage follower circuits VF do not need to scan the power lines 162 nor switch the voltages of the power lines 162. It is therefore possible to hold the voltages of the power lines 162 at the predetermined fixed voltage Vdd with a simpler structure than in the case of providing the dedicated driver for holding the voltages of the multiple power lines 162 at the predetermined fixed voltage Vdd. As a result, the production cost can be reduced.

While the embodiments and variation of the present invention have been described above, the present invention is not limited to these embodiments and variation. The scope of the present invention includes other embodiments that are obtained by making various modification that those skilled in the art could think of, to the present embodiments and variation, or by combining constituents in different embodiments and variation.

Figure 11:
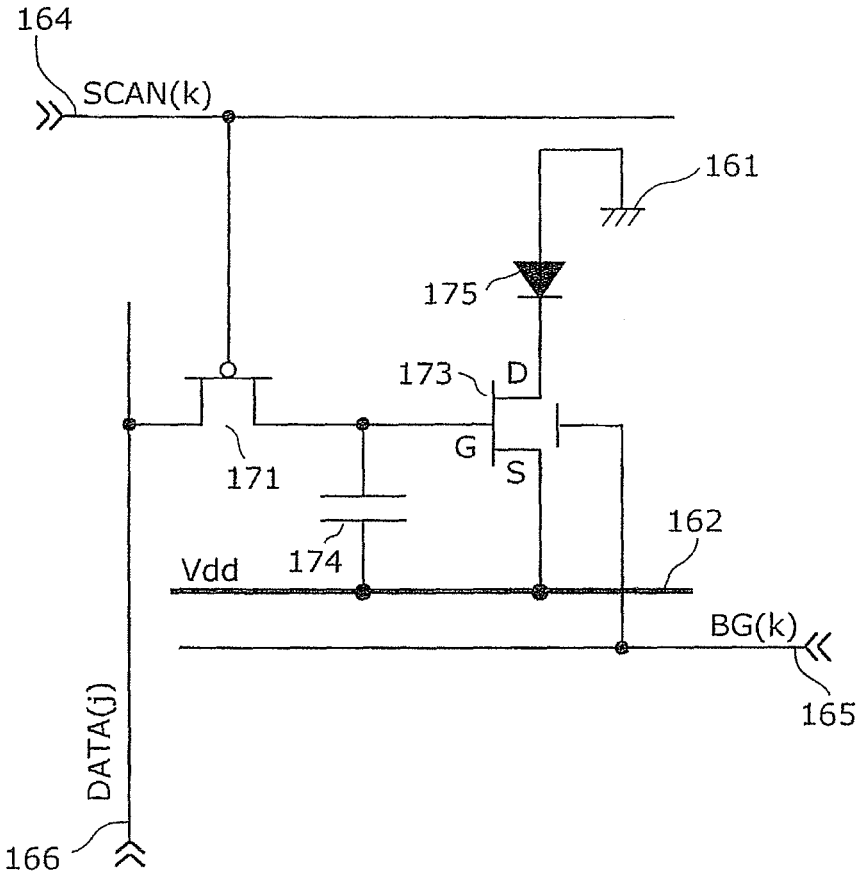
FIG. 11 schematically shows one example of a circuitry design of a luminescent pixel when a drive transistor is an N-type transistor.

For example, in the above description, the scan transistor is an N-type transistor which is conducting when the pulse that is applied to the gate electrode is at high level, and the drive transistor is a P-type transistor which is conducting when the pulse that is applied to the gate electrode is at low level, but these transistors may each have an opposite polarity with the scan line 164 and the bias line 165 each having an opposite polarity, in a circuitry design shown in FIG. 11, for example.

The polarity of the drive transistor may be the same as the polarity of the scan transistor.

Furthermore, while the drive transistor and the scan transistor are each a TFT in the above description, they may be junction field effect transistors, for example. Alternatively, these transistors may each be a bipolar transistor having a base, a collector, and an emitter.

While the power line 161 is a ground line in the above embodiments, the power line 161 may be connected to the DC power supply 150 and supplied with a voltage (e.g., 1 V) other than 0 V.

The voltage clamp unit for fixing the voltage of the power line 162 is not limited to the above voltage follower circuit VF and may be an isolation amplifier.

In the organic EL display device 400, each power line 162 has two voltage follower circuits VF in the above embodiment, but may have one voltage follower circuit VF.

Figure 12:
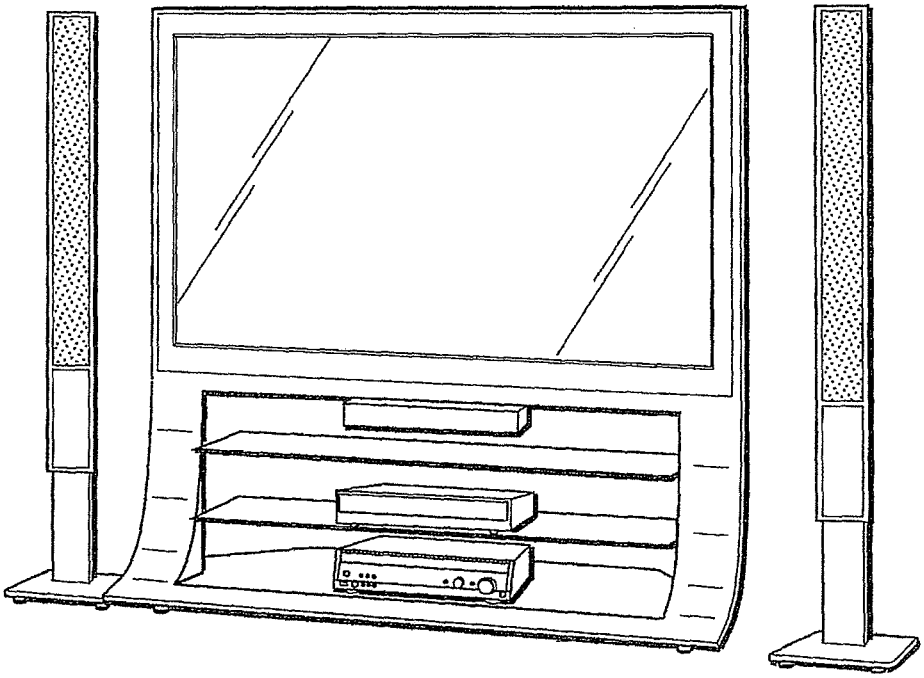
FIG. 12 shows appearance of a thin flat-screen television including the organic EL display device according to an implementation of the present invention.

The organic EL display device according to an implementation of the present invention is, for example, incorporated into such a thin flat-screen television as shown in FIG. 12. A thin flat-screen television including the organic EL display device according to an implementation of the present invention is capable of displaying highly precise images which reflect video signals.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The present invention is useful especially for an active organic EL flat-panel display.

What is claimed is:

1. An organic electroluminescent display device, comprising:

a display including a plurality of pixels arranged in a matrix, each of the plurality of pixels including:

a luminescent element;

a driver for controlling a current flow to the luminescent element, the driver including a source electrode, a drain electrode, a gate electrode, and a back gate electrode, the driver being in a non-conducting state when a predetermined bias voltage is provided to the back gate electrode;

a capacitor including a first electrode connected to the gate electrode of the driver and a second electrode connected to the source electrode of the driver; and a switch including a first terminal and a second terminal that is connected to the first electrode of the capacitor;

a plurality of scan lines for providing a scan signal for scanning the plurality of pixels included in the display;

a plurality of data lines for providing a signal voltage to the plurality of pixels included in the display, the first terminal of the switch being connected to a corresponding one of the plurality of data lines for switching between a conduction state and a non-conduction state between the corresponding one of the plurality of data lines and the first electrode of the capacitor;

a trunk power line disposed about a periphery of the display for providing a predetermined fixed voltage to the display;

a power supply for providing the predetermined fixed voltage to the trunk power line via an external input;

a plurality of first power lines that each correspond to one of the plurality of scan lines, the plurality of first power lines each branching from the trunk power line and being separate from others of the plurality of first power lines in the display, the plurality of first power lines each extending along the one of the plurality of scan lines and being electrically connected to the source electrode of the driver of corresponding ones of the plurality of pixels;

a second power line electrically connected to the drain electrode of the driver;

a bias line for providing the predetermined bias voltage to the back gate electrode; and a drive circuit that controls the switch and the predetermined bias voltage that is provided to the back gate electrode, wherein the predetermined bias voltage is provided so that an absolute value of a threshold voltage of the driver is greater than a gate-source voltage between the gate electrode and the source electrode, the drive circuit provides the predetermined bias voltage to the back gate electrode so that the absolute value of the threshold voltage of the driver is greater than the gate-source voltage between the gate electrode and the source electrode to place the driver in the non-conducting state, and provides the signal voltage to the first electrode of the capacitor when the driver is in the non-conducting state by placing the switch in the conduction state during a period in which the predetermined bias voltage is provided to the back gate electrode, and the predetermined bias voltage that is provided to the back gate electrode so that the absolute value of the threshold voltage of the driver is greater than the gate-source voltage between the gate electrode and the source electrode is set so that the absolute value of the threshold voltage is greater than the gate-source voltage between the gate electrode and the source electrode when the gate electrode of the driver is provided with a predetermined signal voltage required to cause the luminescent element included in each of the plurality of pixels to produce luminescence with a maximum gradation level.

2. The organic electroluminescent display device according to claim 1, wherein the signal voltage is provided to the first electrode of the capacitor during the period in which the predetermined bias voltage is provided to the back gate electrode.

3. The organic electroluminescent display device according to claim 2, wherein the switch and the driver include transistors of opposite polarities, and one of the plurality of scan lines and the bias line are provided as a common control line.

4. The organic electroluminescent display device according to claim 1, wherein the driver is a P-type transistor.

5. The organic electroluminescent display device according to claim 4, wherein the drive circuit:

provides the signal voltage to the first electrode of the capacitor and then places the switch in the non-conduction state;

provides, to the back gate electrode, a voltage less than the predetermined bias voltage so that the absolute value of the threshold voltage of the driver is less than the gate-source voltage between the gate electrode and the source electrode to place the driver in a conducting state; and provides, to the luminescent element, a drive current corresponding to a voltage held by the capacitor to cause the luminescent element to produce luminescence.

6. The organic electroluminescent display device according to claim 1, wherein the driver is an N-type transistor.

7. The organic electroluminescent display device according to claim 6, wherein the drive circuit:

provides the signal voltage to the first electrode of the capacitor and then places the switch in the non-conduction state;

provides, to the back gate electrode, a voltage greater than the predetermined bias voltage so that the absolute value of the threshold voltage of the driver is less than the gate-source voltage between the gate electrode and the source electrode to place the driver in a conducting state; and provides, to the luminescent element, a drive current corresponding to a voltage held by the capacitor to cause the luminescent element to produce luminescence.

8. A method of controlling an organic electroluminescent display device that includes:

a display including a plurality of pixel units arranged in a matrix, each of the plurality of pixels including:

a luminescent element;

a driver for controlling a current flow to the luminescent element, the driver including a source electrode, a drain electrode, a gate electrode, and a back gate electrode, the driver being in a non-conducting state when a predetermined bias voltage is provided to the back gate electrode;

a capacitor including a first electrode connected to a gate electrode of the driver and a second electrode connected to the source electrode of the driver; and a switch including a first terminal and a second terminal that is connected to the first electrode of the capacitor;

a plurality of scan lines for providing a scan signal for scanning the plurality of pixels included in the display;

a plurality of data lines for providing a signal voltage to the plurality of pixels included in the display, the first terminal of the switch being connected to a corresponding one of the plurality of data lines for switching between a conduction state and a non-conduction state between the corresponding one of the plurality of data lines and the first electrode of the capacitor;

a trunk power line disposed about a periphery of the display for providing a predetermined fixed voltage to the display;

a power supply for providing the predetermined fixed voltage to the trunk power line via an external input;

a plurality of first power lines that each correspond to one of the plurality of scan lines, the plurality of first power lines each branching from the trunk power line and being separate from others of the plurality of first power lines in the display, the plurality of first power lines each extending along the one of the plurality of scan lines and being electrically connected to the source electrode of the driver of corresponding ones of the plurality of pixels;

a second power line electrically connected to the drain electrode of the driver; and a bias line for providing the predetermined bias voltage to the back gate electrode, the predetermined bias voltage being provided so that an absolute value of a threshold voltage of the driver is greater than a gate-source voltage between the gate electrode and the source electrode, the method comprising:

providing the predetermined bias voltage to the back gate electrode so that the absolute value of the threshold voltage of the driver is greater than the gate-source voltage between the gate electrode and the source electrode to place the driver in the non-conducting state; and providing the signal voltage to the first electrode of the capacitor when the driver is in the non-conducting state by placing the switch in the conduction state during a period in which the predetermined bias voltage is provided to the back gate electrode, wherein the predetermined bias voltage that is provided to the back gate electrode so that the absolute value of the threshold voltage of the driver is greater than the gate-source voltage between the gate electrode and the source electrode is set so that the absolute value of the threshold voltage is greater than the gate-source voltage between the gate electrode and the source electrode when the gate electrode of the driver is provided with a predetermined signal voltage required to cause the luminescent element included in each of the plurality of pixels to produce luminescence with a maximum gradation level.

* * * * *